United States Patent [19]

Richardson, III

[11] 3,958,240

[45] May 18, 1976

[54] ALARM AND STATUS MONITORING SYSTEM

[75] Inventor: Edward M. Richardson, III, Richmond, Va.

[73] Assignee: Robertshaw Controls Company, Richmond, Va.

[22] Filed: Mar. 6, 1973

[21] Appl. No.: 338,493

[52] U.S. Cl. ..... 340/413; 340/147 LP; 340/152 R; 346/17; 346/34

[51] Int. Cl.² ..... G08B 19/00

[58] Field of Search ..... 340/213.1, 213, 412, 340/413, 414, 415, 163; 200/42 R, 44

[56] References Cited

UNITED STATES PATENTS

| | | | |
|---|---|---|---|
| 3,278,920 | 10/1966 | Sargent | 340/413 |
| 3,404,393 | 10/1968 | Blivice | 340/409 |
| 3,413,606 | 11/1968 | Cichanowicz | 340/163 |
| 3,544,769 | 12/1970 | Hedin | 235/61.9 |
| 3,582,925 | 6/1971 | Porter | 340/213.1 |
| 3,638,191 | 1/1972 | Mann | 340/413 |
| 3,676,878 | 7/1972 | Linder | 340/413 |
| 3,697,953 | 10/1972 | Schoenwitz | 340/163 |

*Primary Examiner*—Thomas B. Habecker
*Attorney, Agent, or Firm*—Anthony A. O'Brien

[57] ABSTRACT

Sequentially generated pulses are applied to respective groups of alarm and status condition responsive contacts. A memory is indexed in accordance with the pulses to store individual condition signals received from respective contacts in each group and activate alarm or status indicators. A lock switch operates facilites for partially disabling a manual acknowledge switch which turns off audible and blinking alarm indicators. A printer records the time and a character indicating the specific alarm contact which was activated. Alarm summary command or alarm status summary command switches may be selectively operated to produce a print out of all alarm conditions or a print out of all alarm conditions and the status of all status contacts. The system employs modular units which may be selectively connected in the system to provide lamp annunciator functions and/or printing functions for selective sized groups of contacts.

3 Claims, 18 Drawing Figures

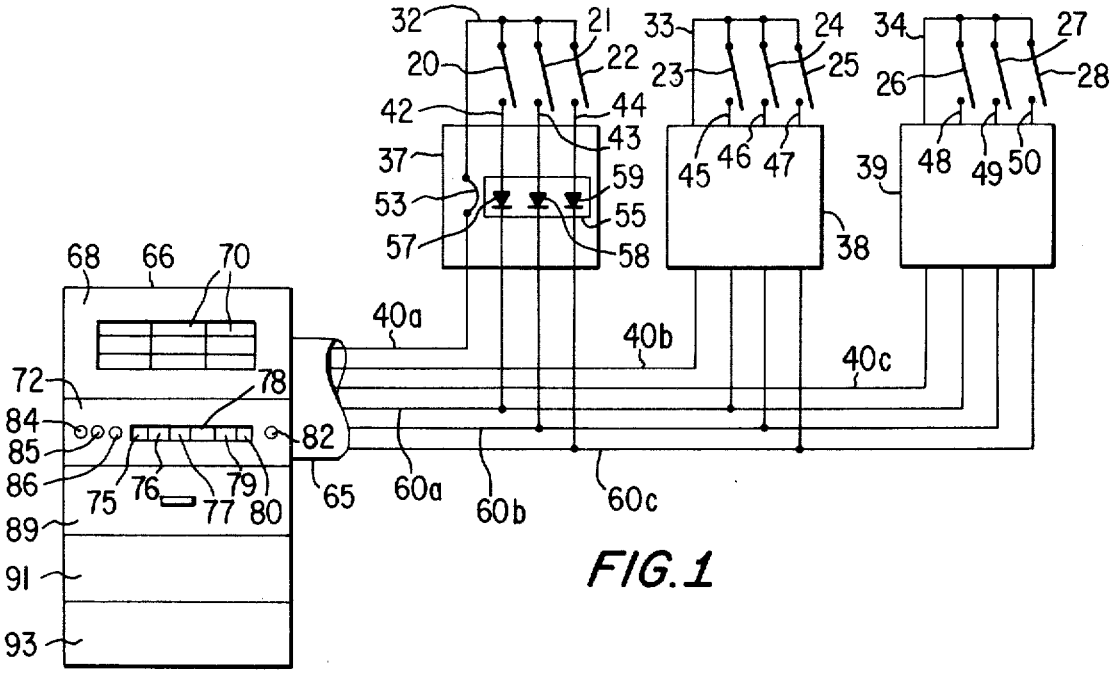
FIG. 1
FIG. 3
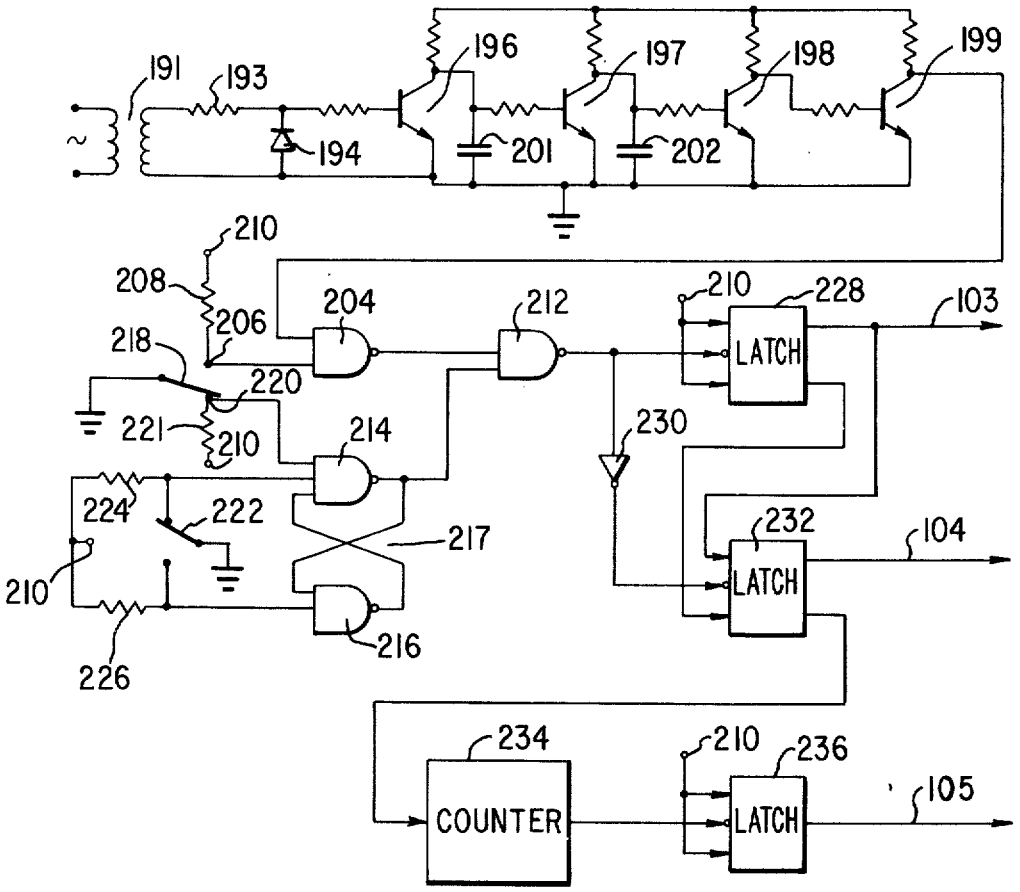

FIG. 11
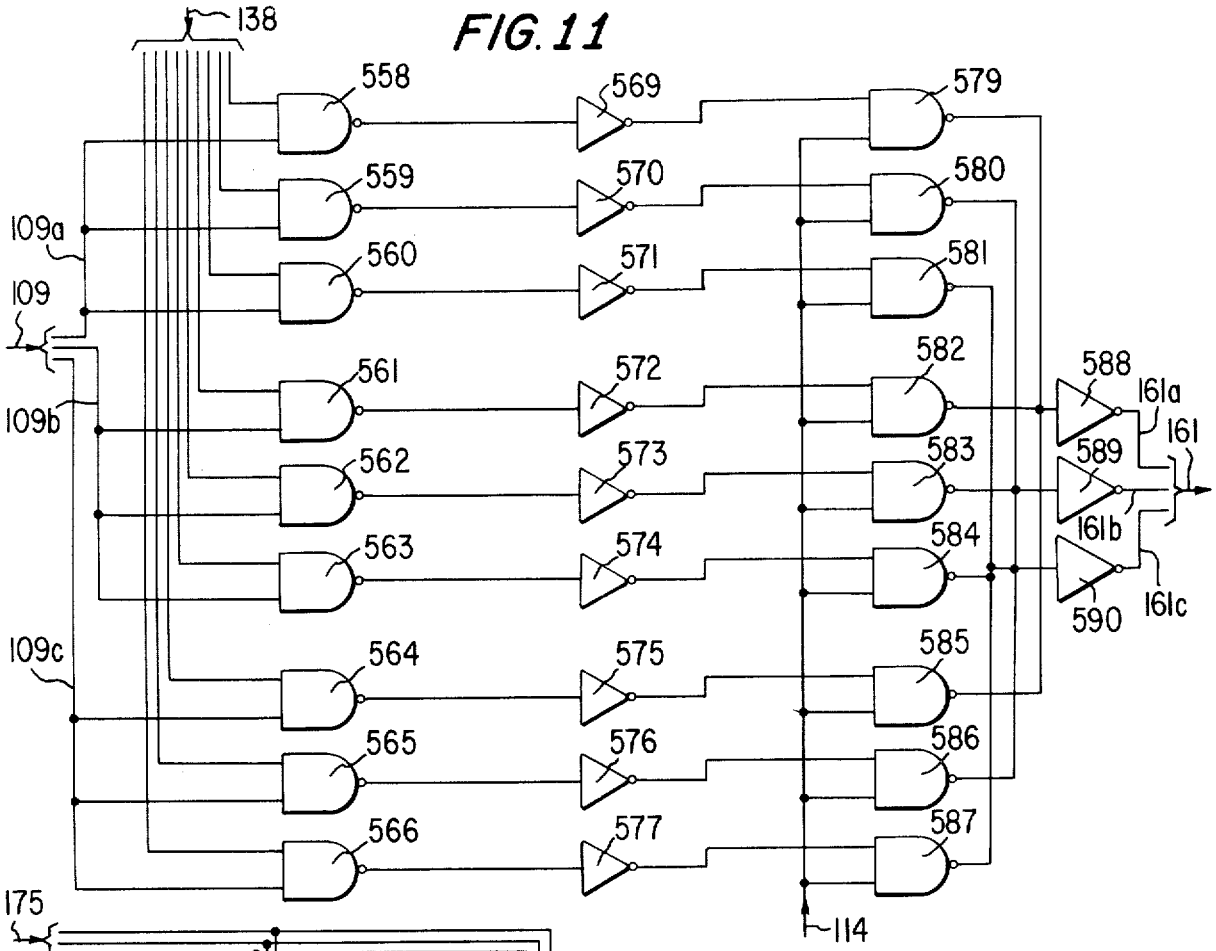
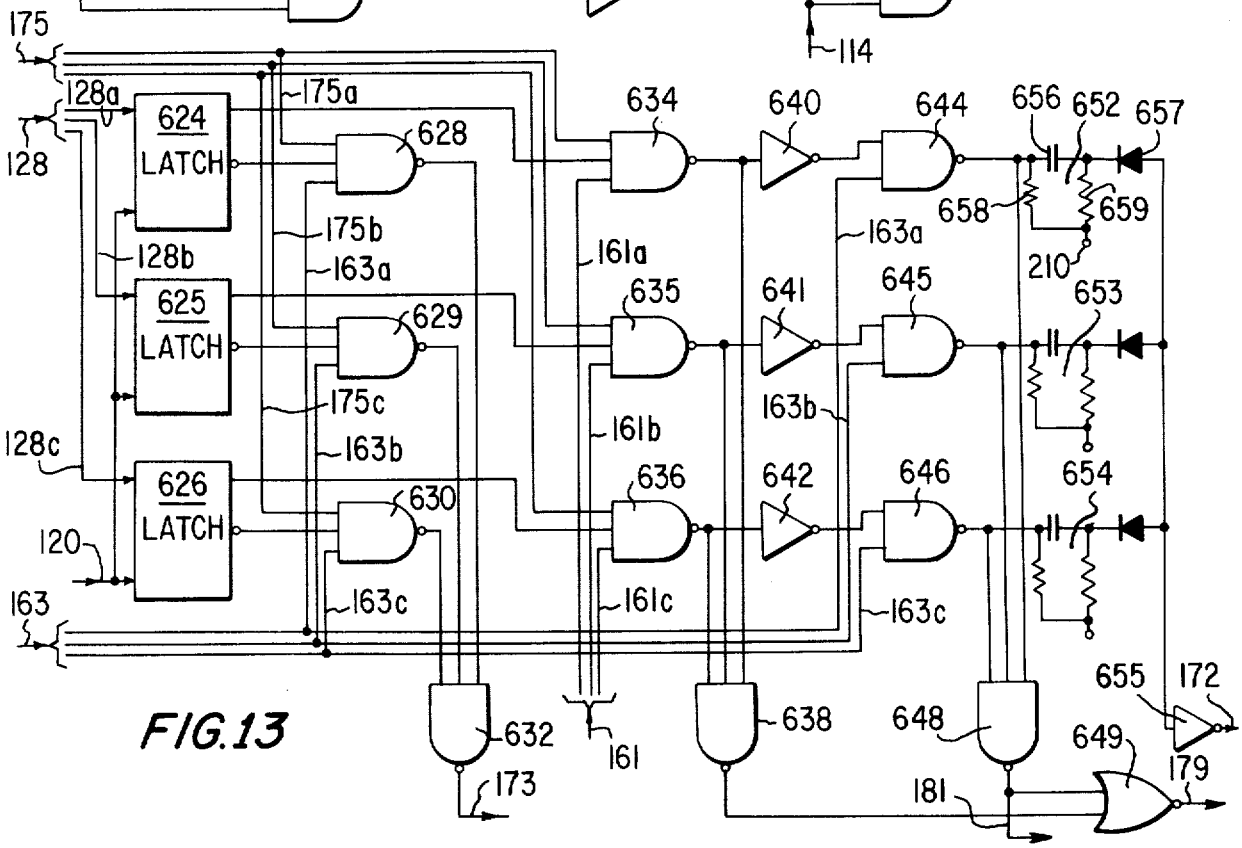
FIG. 13

ALARM AND STATUS MONITORING SYSTEM

BACKGROUND OF THE INVENTION

1. Field of the Invention

This invention relates to condition monitoring systems wherein a plurality of contacts at remote locations or points are monitored at a central location to sense an alarm or status condition at the remote locations.

2. Description of the Prior Art

Examples of prior art condition monitoring systems are described in U.S. Pat. Nos. 3,447,145; 3,451,058; 3,518,653; 3,611,363; 3,644,891; 3,644,894 and 3,714,646. The prior art condition monitoring systems cannot be easily adapted to a wide variety of different applications, each system may have to be modified extensively in order to fit a particular application. Another disadvantage of the prior art systems is that alarms and other indicators associated with the systems can be de-activated by unauthorized persons, thus an alarm condition could be undetected by an authorized person returning after a temporary absense.

SUMMARY OF THE INVENTION

In one aspect of the invention, a condition monitoring system includes a plurality of means, each responsive to a condition for producing an electrical signal indicating the condition; an indicator; means for operating the indicator in response to a signal produced by one of the plurality of means; manual switch means for terminating the operation of the indicator operating means to acknowledge the condition; a lock switch which has means for securing the lock switch to prevent unauthorized operation thereof; and means operated by the lock switch for disabling the manual switch means.

In another aspect of the invention, a condition monitoring system includes a plurality of condition means, each for operating in response to a condition, with first and second condition means in a first group of condition means and third and fourth condition means in a second group of condition means; a plurality of memory means for storing condition signals with first, second, third and fourth memory means; sensing means for (a) simultaneously scanning the first group of condition means to generate first and second condition signals corresponding to the conditions of respective first and second condition means and (b) thereafter simultaneously sensing the second group of condition means to generate third and fourth condition signals corresponding to the conditions of the respective third and fourth condition means; and applying means controlled by the scanning means for applying the first and second condition signals to the respective first and second memory means and thereafter for applying the third and fourth condition signals to the respective third and fourth memory means.

In still another aspect of the invention, an apparatus for forming a modular condition monitoring system which may employ an annunciator panel and a printer includes a frame, receiving means mounted on the frame for receiving signals indicating conditions at a plurality of points, first connecting means mounted on the frame for electrically connecting to an annunciator panel, second connecting means mounted on the frame for electrically connecting to a printer, third connecting means mounted on the frame and electrically interposed between the receiving means and the first connecting means for connecting to a modular annunciator interface circuit unit, and fourth connecting means mounted on the frame and electrically interposed between the receiving means and the second connecting means for connecting to a modular printer operating unit.

One feature of the invention is that there may be alternately or jointly provided printing facilities and/or light display facilities for indicating conditions being monitored. The printing facilities print the time and a character indicating the location of an alarm condition. The light display facilities include a plurality of light producing indicators corresponding to the points at which conditions are monitored.

Another feature of the invention is the provision of a light producing indicator, an audible alarm and facilities for operating the audible alarm and for blinking the light producing indicator in response to an alarm condition. Acknowledgement of the alarm condition terminates the operation of the audible alarm and changes the blinking light to a steady light. Lock switch means prevents the termination of the blinking of the light.

Still another feature of the invention is that facilities may be programmed to distinguish points at which status conditions are being monitored from points at which alarm conditions are being monitored.

A further feature of the invention is the provision of first and second latch circuits in memory means corresponding to each point wherein each first latch circuit receives condition signals from each point and the second latch circuits store signals indicating acknowledgement of the received signals.

A still further feature of the invention is the provision of facilities for delaying the operation of the monitoring system for a predetermined duration after a power failure. Alarm conditions prior to resumption of operation are indicated as acknowledged conditions.

An additional feature of the invention is the provision of sequencing means generating a set signal and sequential station scanning signals wherein acknowledge facilities are enabled only during the set signal.

A further additional feature of the invention is the provision of automatic facilities for operating a printer to identify new alarms and manual facilities for operating the printer to identify all alarm conditions. Also, manual facilities operate the printer to print a summary of all alarm conditions and the status of all status points.

A still further additional feature of the invention is the provision of facilities for inserting cycles of normal alarm scanning operations in between point scanning cycles of each station during a summary printing operation to sense any new alarm conditions prior to the end of the summary.

Other features and advantages of the invention will become apparent from the following description of the preferred embodiment taken in conjunction with the drawings.

BRIEF DESCRIPTION OF THE DRAWINGS a manual 1 is a diagram of a condition monitoring system in accordance with the invention;

FIG. 3 is a diagram of a system clock of the circuitry shown in FIG. 2;

FIG. 11 is a diagram of a print inhibit circuit which is employed in the circuitry of FIG. 2;

FIG. 13 shows a diagram of a alarm-status print decoder circuit which is used in the circuitry of FIG. 2;

DESCRIPTION OF THE PREFERRED EMBODIMENT

Figure 2:
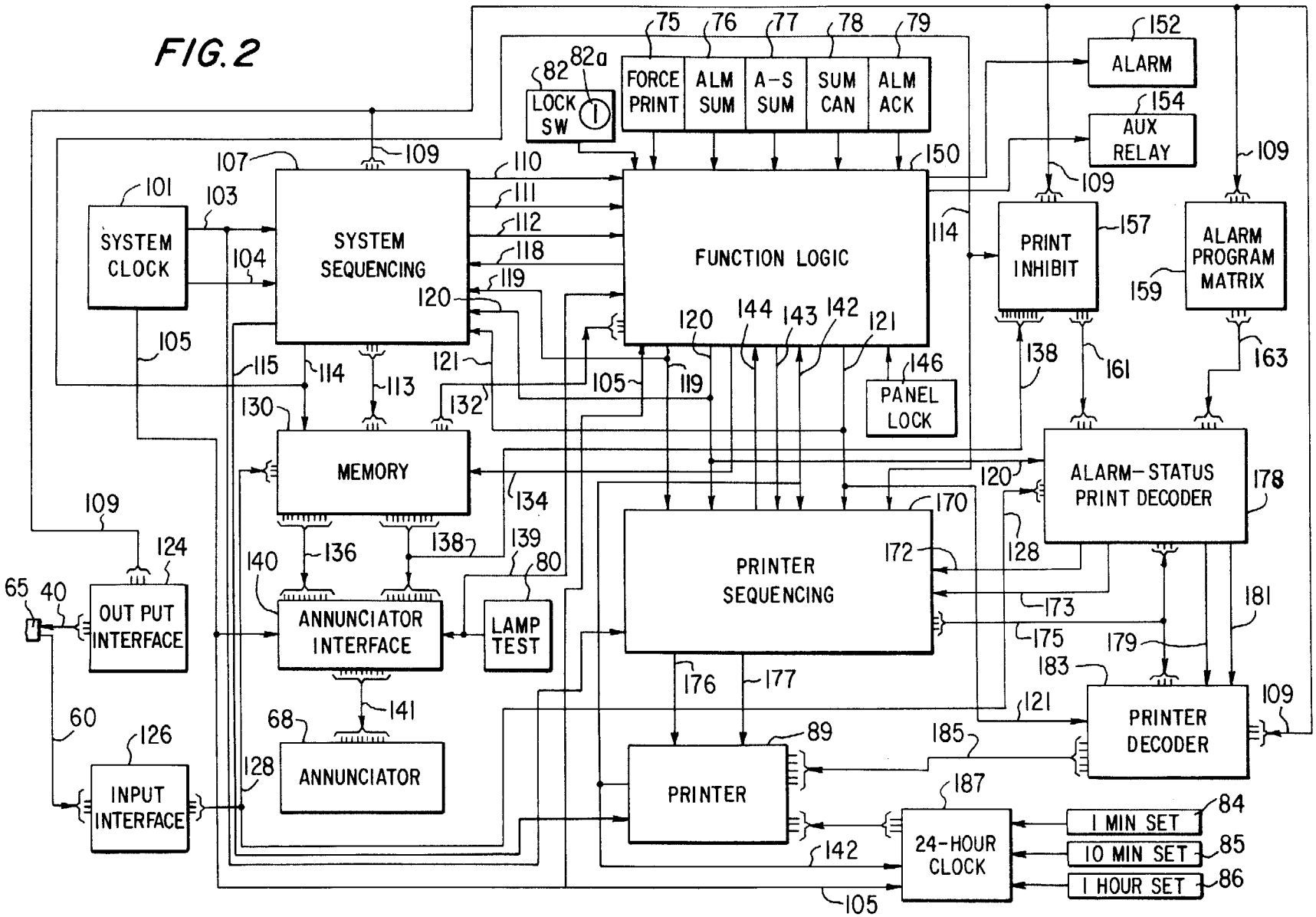
FIG. 2 is a block diagram illustrating the interconnection of electronic circuits included in a console of the system shown in FIG. 1.

Referring first to FIG. 1 there are shown a plurality of contacts 20–28 each of which may be operated by a alarm or status condition sensing device (not shown). The contacts 20–22 are in a first group while the contacts 23–25 and 26–28 are in second and third groups respectively. Each group is located at a remote station or location near points where conditions are to be monitored. Common lines 32, 33 and 34 connect one terminal of each of the contacts in the respective groups of contacts 20–22, 23–25 and 26–28 to respective station or field boxes 37–39. The other terminals of the switches 20–28 are connected to the station boxes 37–39 by lines 42–50. Within the station box 37 a strap 53 connects the line 32 to a line **40*a* and a printed circuit board 55 having diodes 57–59 thereon connects the lines 42, 43 and 44 to respective lines 60*a*, 60*b* and 60*c*. Similar circuitry (not shown) in the boxes 38 and 39 connect the lines 33 and 34 to respective lines 40*b* and 40*c* and connects the lines 45–47 and 48–50 to the respective lines 60*a*, 60*b* and 60*c*.**

The lines **40*a*, 40*b*, 40*c*, 60*a*, 60*b*, and 60*c* form part of a multiconductor cable 65 which connects the field boxes to a console 66 which monitors the contacts 20–28 to indicate a condition. The console 66 has an annunciator panel 68 with a plurality of windows 70–70 having respective legends identifying points or conditions being monitored. Each of the windows 70–70 or legends thereon may be lit by a lamp behind each window to indicate an alarm or status condition. Also the console 66 has a control panel 72 with a plurality of control function switches 75–80, a lock switch 82 and three push button switches 84–86. The function switches 75–80 control the functions force print, alarm summary, alarm status summary, summary cancel, alarm acknowledge and lamp test respectively. The push button switches 84–86 are used to advance a 24-hour clock circuit by a minute, 10 minutes and an hour respectively. The lock switch 82 is any switch with facilities, such as a key tumbler 82*a* (FIG. 2), for securing the switch to prevent unauthorized operation. The switch 82 when operated serves to disable the switches 75–79 and 84–86. Additionally, console 66 has a printer 89, a panel 91 containing electronic circuitry for preforming monitoring functions and a panel 93** which contains power supplies for generating operating voltages for the monitoring system.

The monitoring system shown in the drawings and described herein illustrates the monitoring of nine condition points connected by a cable 65 containing six lines to the console 66. Suitable provisions in the monitoring system could be made to monitor less or many more points. In the specification and drawings there are often illustrated a plurality of lines which carry similar function signals, for example lines **40*a*, 40*b* and 40*c*. Such lines are referenced collectively by a number, for example 40, and individually by the same number followed by a small letter, for example 40*a*, 40*b* and 40*c*.**

The general electronic circuitry is shown in the block diagram of FIG. 2. A system clock circuit 101 produces control clock signals illustrated in FIG. 15, on output lines 103, 104 and 105. The signal on line 103 is a first phase 30 hertz square wave and the signal on line 104 is a second phase 30 hertz square wave which is delayed from the first phase signal by 90°. The signal on line 105 is a 1.5 hertz square wave. The lines 103 and 104 are connected to a system sequencing circuit 107. The system sequencing circuit 107 produces various control signals on output lines 109–115 in response to the clock signals on lines 103 and 104 and input signals on lines 118–121. Lines 109 are connected to an output interface circuit 124 which connects the lines 109 to the respective lines 40 to sequentially apply station sequencing signals, illustrated in FIG. 15, over the lines **40*a*, 40*b* and 40*c* to the respective lines 32–34 of FIG. 1. Any signals on the lines 40 which are passed by closed contacts 20–28 of FIG. 1 come back on lines 60 to an input interface circuit 126. The data signals on lines 60 are applied by the input interface circuit 126 to lines 128 which are connected to inputs of a memory 130. The output lines 113 and 114 of the system sequencing circuit 107 are connected to the memory 130 to transfer the date of the lines 128 to respective individual units in the memory 130. Upon receipt of data indicating an alarm condition, the memory 130 produces an alarm pulse on one of lines 132 which are connected to a function logic circuit 150. When the alarm acknowledge switch 80 is manually operated, the function logic circuit applies an alarm acknowledge signal over line 134 to the memory 130. The data stored in the memory 130 produces alarm status signals on lines 136, and after acknowledgement, the memory 130 produces acknowledged alarm signals on lines 138. The lines 136 and 138 along with the line 105 from the system clock 101 and a line 139 from the lamp test switch 79 are connected to inputs of an annunciator interface circuit 140. The annunciator interface circuit 140 is connected by lines 141 to lamps behind the legend windows 70–70 of the annunciator panel 68.**

The lines 110, 111, 112, 132, and 139 along with lines 142 and 144 and the function switches 75–80, lock switch 82 and a panel switch 146 are connected to inputs of the function logic circuit 150. In response to the signals received, the function logic circuit 150 produces various control signals on output lines 118, 119, 120, 121, 134 and 143. Also the function logic circuit 150 operates an audible alarm 152 and an auxilially relay 154 when data indicating an alarm is received by the memory 130.

The lines 109 are also connected to inputs of a print inhibit circuit 157 and a alarm program matrix circuit 159. The print inhibit circuit 157 receives the station selection signals on the lines 109 along with the acknowledged alarm signals on the lines 138 and the memory hold signals on the line 114 to produce inhibit signals on lines 161 corresponding to stored conditions which have been acknowledged. The alarm program matrix circuit 159 receives the station selection signals on the lines 109 and produces alarm enable signals to lines 163 corresponding only to points which are programmed for alarm conditions.

Once an alarm condition has been sensed, an alarm summary has been ordered or an alarm status summary has been ordered, the printer sequencer circuit 170 having inputs connected to lines 103, 114, 119, 120, 121, 142, 143, 172 and 173 produces various control signals on lines 144, 175, 176 and 177 to control a printing cycle. An alarm status print decoder circuit 178 has inputs connected to lines 120, 128, 161, 163 and 175 to produce various control signals on the lines 172 and 173 along with lines 179 and 181 to control the data which is to be printed. A printer decoder circuit 183 has inputs connected to lines 109, 121, 175, 179 and 181 to apply printer information signals on lines 185 to the printer 89. Also the printer 89 receives signals indicating the time in minutes and hours from a 24-hour clock circuit 187, print command signals on line 176, paper feed signals on line 177 and N print signals on line 115. The 24-hour clock circuit 187 is operated by the 1.5 hertz signals on line 105 and a busy command signal on line 142. The switches 84–86 may be used to set the 24-hour clock circuit.

The printer 89 is one of the many commercially available printing units which can be controlled to print data from data sources. The printer decoder circuit 183 has conventional logic circuits disabled by a force print signal on line 121 and which are designed to convert parallel data such as the station selection signals on the lines 109 and point scanning signals on the lines 175, into a code acceptable to the printer 89. Additionally, the printer decoder circuit 183 has logic circuits controlled by the on-off command signal on line 179 and the red print signal on line 181 to produce suitable signals to cause the printer 89 to print alarm condition indications in red and to print "on" or "off" in the absence of a red print signal. Inasmuch as suitable printers are well known in the art and conventional decoding circuitry may be easily designed, there is no further description herein of the printer 89 and the printer decoder circuit 183.

System Clock (FIG. 3.)

Referring next to FIG. 3 there is shown a circuit diagram of the system clock 101. Conventionally available 60 hertz power is applied by transformer 191 to a resister 193 and rectifying diode 194. The diode 194 produces 60 hertz half wave rectified pulses which are applied to four serially connected transistor amplifier circuits 196–199. The first two amplifying circuits 196 and 197 have respective capacitors 201 and 202 connected acorss the output thereof to smooth out the pulses and eliminate unwanted high frequency components. The latter two amplifier circuits 198 and 199 serve to shape the pulses to produce substantially square pulses on the output thereof.

The squared pulses from the amplifier 199 are applied to one input of the nand gate 204 which has a second input connected to a contact terminal 206. The terminal 206 is normally biased positive by a resistor 208 connected to a voltage source 210. Pulses from the output of the nand gate 204 are applied to one input of the nand gate 212 which has a second input normally biased positive by the output of the nand gate 214. The gate 214 is interconnected with a nand gate 216 in a flip flop 217. The nand gate 214 has a input connected to a terminal 220 which is normally grounded by a test switch contact 218. When the contact 218 is moved to the terminal 206 the input of the nand gate 204 is grounded while the input of the nand gate 214 from the terminal 220 is biased positive by a voltage through a resistor 221 from the voltage source 210. A high low switch 222 may be alternately flipped to ground respective inputs of the respective nand gates 214 and 216 which are normally biased positive by resistors 224 and 226 connected to the voltage source 210. The switch 222 when the switch 218 engages the terminal 206 is used to supply test signals to the circuitry which are used in diagnostic studies.

Pulses on the output of the nand gate 212 are applied to a gating input of a latch 228 and through an inverter 230 to a gating input of a latch 232. Other inputs of the latch 228 are biased by the source 210 so that the latch 228 changes state upon the receipt of each pulse from the nand gate 212 to produce a substantially square wave signal on the line 103 which has a frequency of 30 hertz. The inputs of the latch 232 are connected to the respective outputs of latch 228 so that the pulses from the inverter 230 alternately trigger the latch 232 on and off to produce a 30 hertz square wave signal on line 104 which lags the 30 hertz clock signal on the line 103 by 90°. Additionally one of the outputs from the latch 232 is applied to the input of a counter circuit 234 which produces an output pulse with every 10th input pulse. The counter 234 is connected to a gating input of a latch circuit 236 having other inputs biased by source 210 to divide by two to produce the 1.5 hertz signal on the line 105.

Figure 4:
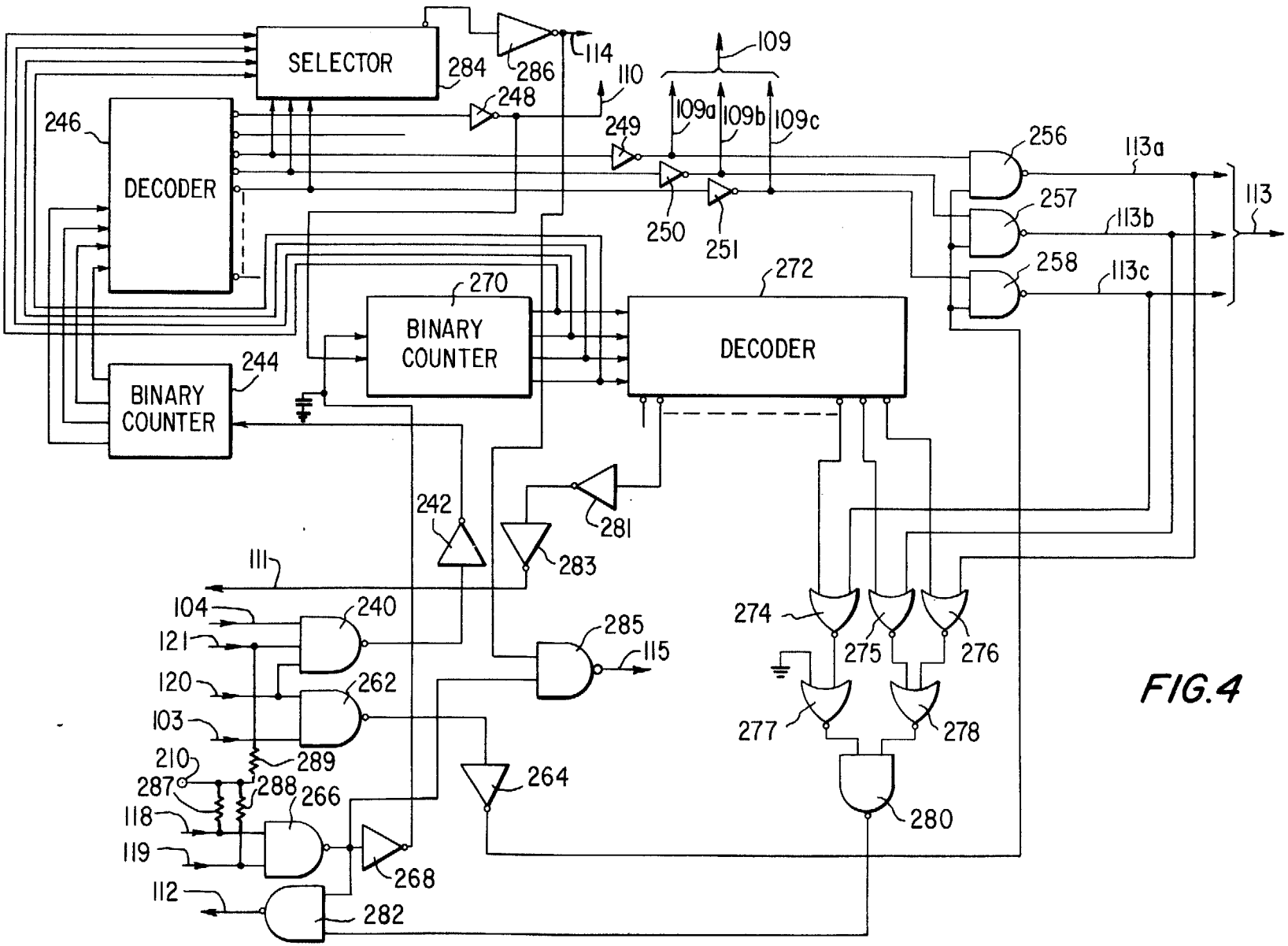
FIG. 4 is a diagram of a system sequencing circuit of the circuitry shown in FIG. 2.

System Sequencing Circuit (FIG. 4)

The system sequencing circuit 107 of FIG. 2 is shown in detail in the logic schematic of FIG. 4. A nand gate 240 has inputs connected to lines 104, 120 and 121 to apply the second phase clock signals through an inverter 242 to an input of a binary counter 244. The nand gate 240 is disabled by a print cycle command signal on line 120 or a force print signal on line 121 to stop the cycling of the binary counter 244. The outputs of the binary counter 244 are connected to inputs of a decoder circuit 246 which converts successive binary signals from the counter 244 into sequential parallel signals. An inverter 248 connects a first output of the decoder 246 to the line 110 to produce set signals thereon while inverters 249, 250 and 251 connect succeeding outputs of the decoder circuit 246 to respective lines **109*a*, 109*b* and 109*c* to produce sequential station selection signals. Additionally the inverters 249–251 apply the station selection signals to the inputs of respective nand gates 256–258. The first phase signal on line 103 is applied through a nand gate 262 and an inverter 264 to second inputs of the nand gates 256–258 to produce data transfer signals on lines 113*a*,**

Figure 15:
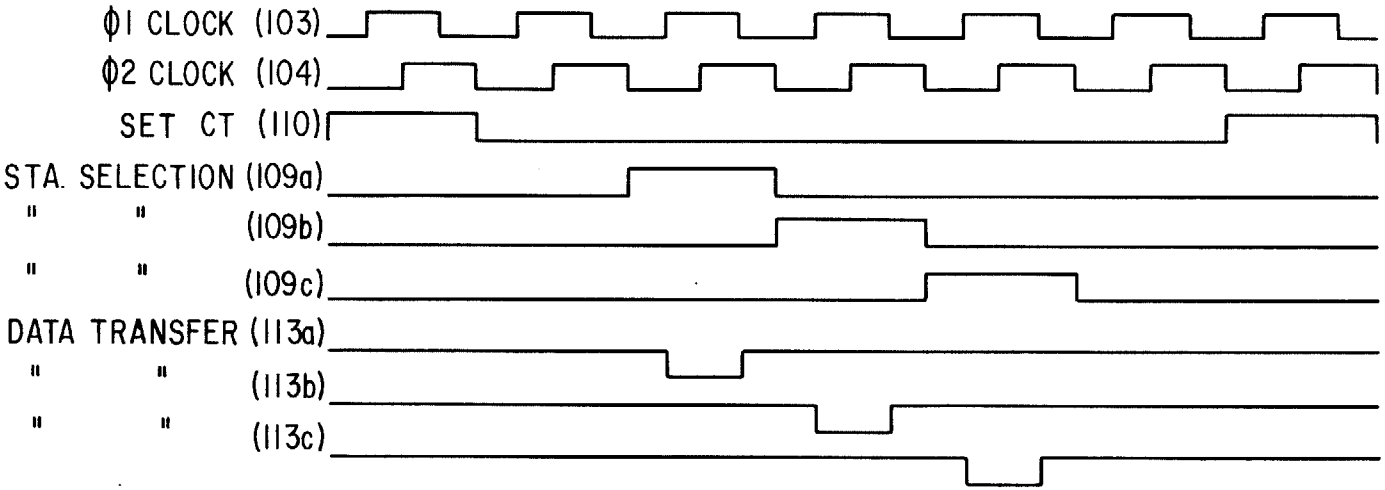
FIG. 15 is a time chart showing signals produced on various points of the monitoring system during a station sequencing operation.

113*b* and 113*c*. The relative timing of the first and second phase signals, the set signal, the station selection signals and the data transfer signals is illustrated in FIG. 15.

When an alarm summary command or alarm status summary command is present on one of the respective lines 118 and 119, a nand gate 266 applies an enabling signal via an inverter 268 to a reset input on a binary counter 270. Set signals on line 110 are applied to another input of the binary counter 270 to step the counter. The outputs of the binary counter 270 are connected to a decoder circuit 272 which has outputs connected to inputs of respect nor gates 274–276. The other inputs of the nor gates 274–276 are connected to the respective lines 113. Outputs of the nor gates 274–276 are connected to respective inputs of nor gates 277 and 278 with one input of gate 277 being grounded. The nor gates 277 and 278 operate a nand gate 280 which applies a signal to a nand gate 282. A second input of the nand gate 282 is connected to the output of the nand gate 266 so that the nand gate 282 produces an alarm status print pulse chain signal on line 112 whenever, the decoder circuit output corresponds to a respective one of the date transfer signals on lines 113. The outputs of the binary counter 270 are also connected to inputs of a data selector 284 along with inputs from the outputs of the decoder 246. When the outputs of the binary counter 270 correspond to the signal generated by the outputs of the decoder 246, the selector 284 produces a memory hold signal through an inverter 286 on the line 114. After succeeding print cycle command signals on line 120 during an alarm summary command signal on line 118 or an alarm status summary command signal on line 119, the counter 270 is stepped by interposed cycles of counter 244 until a summary reset signal is produced from decoder circuit 272 through inverters 281 and 283 on line 111. A nand gate 285 has inputs from the nand gate 266 and line 114 to produce an N print signal on line 115 when there is an absence of a memory hold signal and the presence of either an alarm summary command signal or an alarm status summary command signal. Resistors 287–289 connected to the source 210 provide bias for lines 118, 119 and 121 when printing circuitry is absent.

Figure 5:
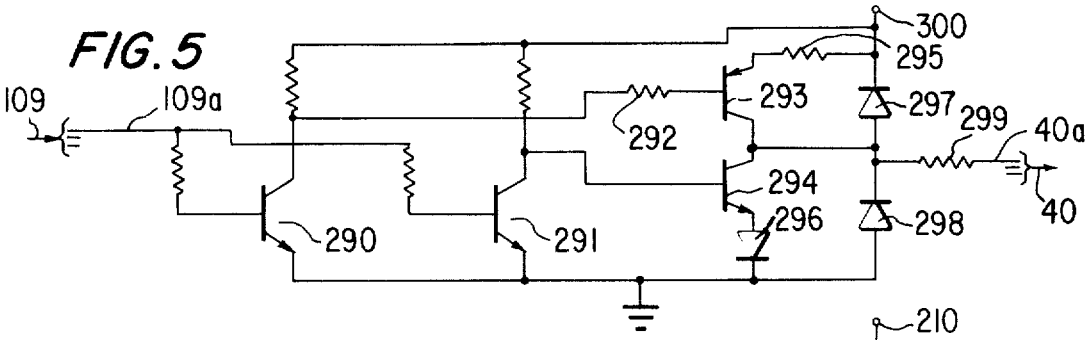
FIG. 5 is a diagram showing a portion of an output interface circuit of the circuitry shown in FIG. 2.

Output Interface Circuit (FIG. 5)

FIG. 5 shows an interface circuit between lines 109*a* and 40*a*, substantially identical interface circuits being connected between respective lines 109*b*–109*c* and 40*b*–40*c*. Line 109*a* is connected to inputs of two parallel transistor amplifier circuits 290 and 291. The output of transistor amplifier 290 is connected by a resistor 292 to the base of a transistor 293. The output of amplifier 291 is connected to the base of a transistor 294. Transistors 293 and 294 are connected in series between a resistor 295 and a diode 296 in a push-pull arrangement across a high voltage source 300. Line 40*a* is connected by resistor 299 to the junction of transistors 293 and 294 connected by protective diodes 297 and 298 to source 300 and ground respectively. The voltage source 300 is selected to increase the voltage of the signals from the line 109*a* to the line 40*a* so that they may be better propogated without interference along the lines 40.

Figure 6:
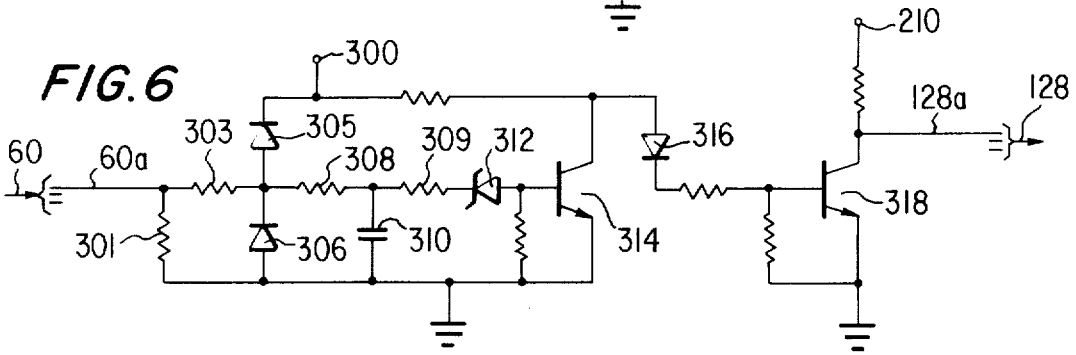
FIG. 6 is a diagram showing a portion of an input interface circuit of the circuitry of FIG. 2.

Input Interface Circuit (FIG. 6)

In FIG. 6, one line 60*a* of the lines 60 is connected across a resistor 301 and by a series resistor 303 to a junction of a pair of diodes 305 and 306 connected in series across the high voltage source 300. A filtering circuit including resistors 308 and 309 and a capacitor 310 is connected in series with the line 60*a*, resistor 303 and a zener diode 312 to the input of a transistor amplifier circuit 314. The output of the amplifier circuit 314 is connected by a diode 316 to the input of a transistor amplifier circuit 318 operated by the low voltage source 210. The output of the amplifier 318 is connected to the line 128*a*. The components of the interface circuit between the lines 60*a* and 128*a* are selected to lower the voltage of the line 60*a* to a voltage which is acceptable to the circuitry within the console 66 as well as to filter unwanted components of noise from the signal. Substantially identical circuits are provided between the lines 60*b*–60*c* and 128*b*–128*c*.

Figure 7:
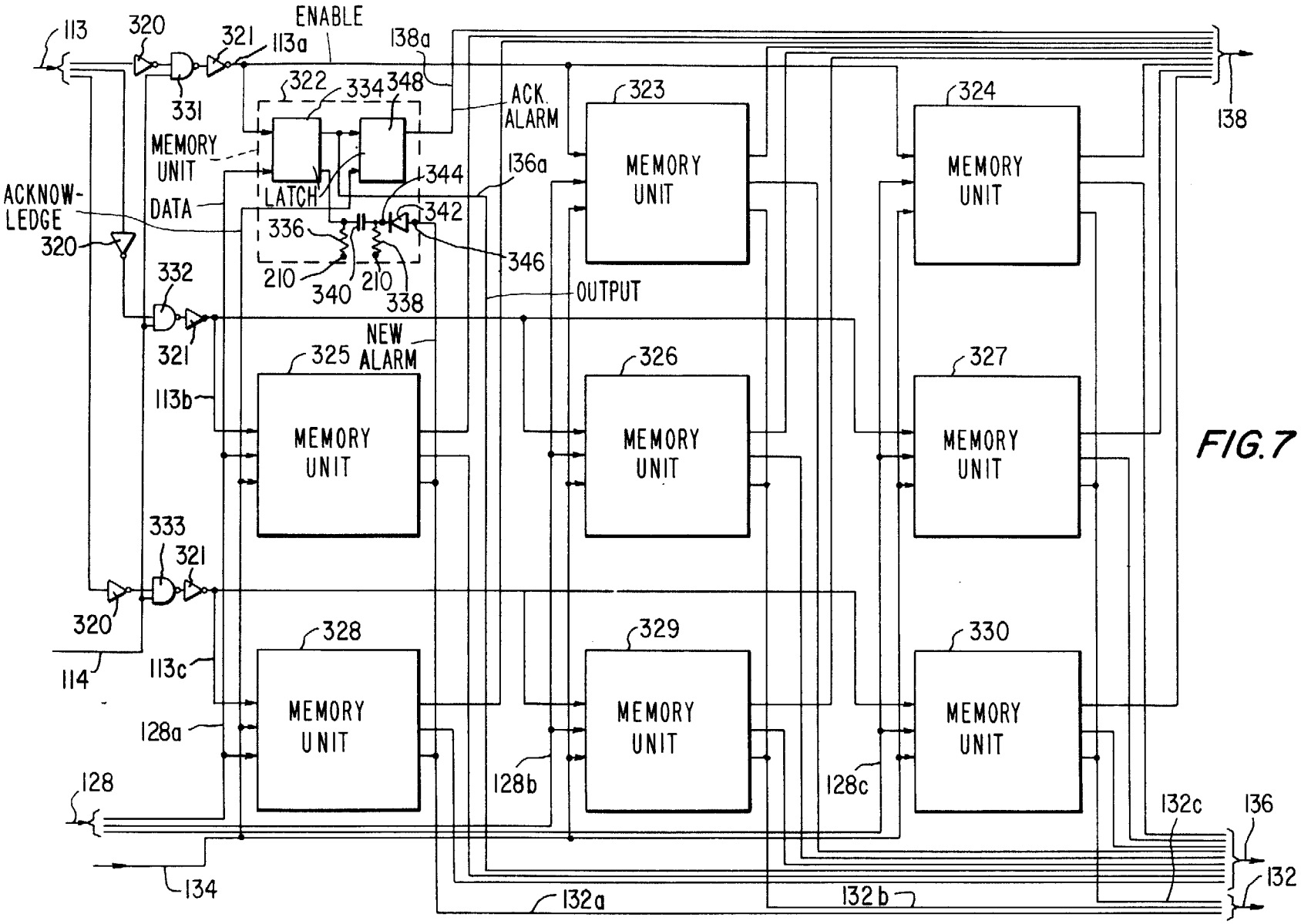
FIG. 7 is a diagram of a memory of the circuitry of FIG. 2.

Memory Circuit (FIG. 7)

The memory circuit 130 of FIG. 2 is shown in detail in FIG. 7. The memory includes a plurality of memory units 322–330. Inputs of a first row of the units 322–324 are connected to a line 113a of the lines of 113, inputs of a second row of the units 325–327 are connected to the line 113*b* of the lines 113 and inputs of a third row the units 328–330 are connected to line 113*c*. Inverters 320–320 and 321–?21 and nand gates 331–333 disabled by a memory hold signal on the line 114 are interposed in the respective lines 113 to block data transfer signals on the lines 113. A first column of the units 322, 325, and 328 have inputs which are connected to the line 128*a* of the lines 128, a second column of the units 323, 326 and 329 have inputs connected to the line 128*b* and a third column of the units 324, 327 and 330 have inputs connected to the line 128*c*. The line 134 is connected to inputs of all the units 322–330.

For simplicity, only the details of the memory unit 322 is shown, the other units 323–330 being substantially identical thereto. The unit 322 has a first latch circuit 334 having inputs to which the lines 128*a* and 113*a* are connected. The line 113*a* is connected to an enabling input of the latch 334 so that data signals on line 128*a* are transfered to the latch 334 when the line 113*a* applies a data transfer signal to the latch 334 to change the latch from a first to a second state. A differentiating circuit has a capacitor 340 and a diode 342 between terminals 344 and 346 serially connected to the negative going output of the latch 334. Resistors 338 and 336 supply bias from the source 210 to opposite sides of the capacitor 340. When data indicating an alarm is received by the latch 334, the differentiating circuit produces an alarm pulse on the line 132*a*. The diode 342 is only connected between the terminals 344 and 346 when the memory unit corresponds to an alarm point being monitored. In the event that the memory unit 322 corresponds to a point where a status condition rather than an alarm condition is being monitored, the diode 342 is removed from the terminals 344 and 346 so that no alarm pulse signal is produced when the condition is stored in the latch 334. The output line 136a of the lines 136 is connected to the output of the latch 334 to receive an alarm status signal when the latch is in its second state. The line 134 applies an alarm acknowledgement signal to an input of a latch 348 to store the information on the output of the latch 334 in the latch 348. Line 138a of the lines 138 is connected to the output of the latch 348 to receive an acknowledged alarm signal.

Figure 8:
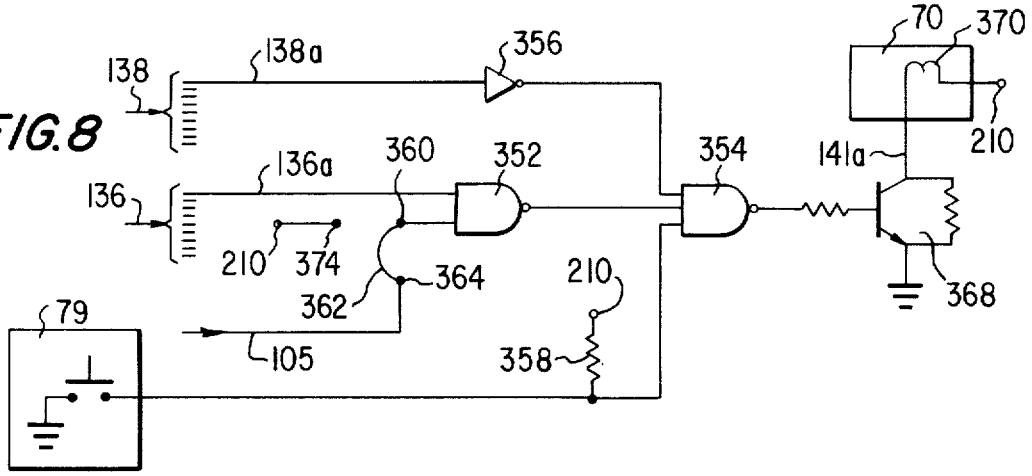
FIG. 8 is a diagram of one portion of an annunciator interface circuit which is employed in FIG. 2.

Annunciator Interface Circuit (FIG. 8)

In FIG. 8 there is illustrated a portion of the annunciator interface circuit 140 of FIG. 2. Only that portion of the interface circuit which is connected to lines 136*a* and 138*a* is shown. Substantially identically circuitry is provided in the annunciator interface circuit for the other lines of the lines 136 and 138. Line 136a is connected to one input of a nand gate 352 which has an output connected to input of a nand gate 354. The line 138*a* is connected by a inverter 356 to another input of the nand gate 354. A third input of the nand gate 354 is normally biased by a resistor 358 connected to voltage source 210. A second input of the nand gate 352 is connected to a terminal 360 which is shown connected by a strap 362 to a terminal 364 connected to the line 105. The line 105 applies the 1.5 hertz signal to the gate 352 so that, upon the receipt of an alarm status signal on the line 136*a*, the nand gate 352 applies a pulsating signal to the nand gate 354. The nand gate 354 has an output connected to the input of the transistor amplifier circuit 368 which is connected by line 141*a* to a lamp 370 behind an annunciator window 70. In event the annunciator window 70 corresponds to a status point rather than an alarm point the strap 362 connects the terminal 360 to a terminal 374 which is connected to the voltage source 210 to apply a steady signal to the lamp 370. Also when an alarm acknowledged signal on line 138*a* is applied by the inverter 356 to an input of the nand gate 354 the gate 354 is disabled to produce a steady light condition of the lamp 370 behind the window 70. To test the operation of the lamp 370, a lamp test switch 79 is operated to ground one input of the nand gate 354 and produce a steady lighted condition of the lamp 370.

Figure 9:
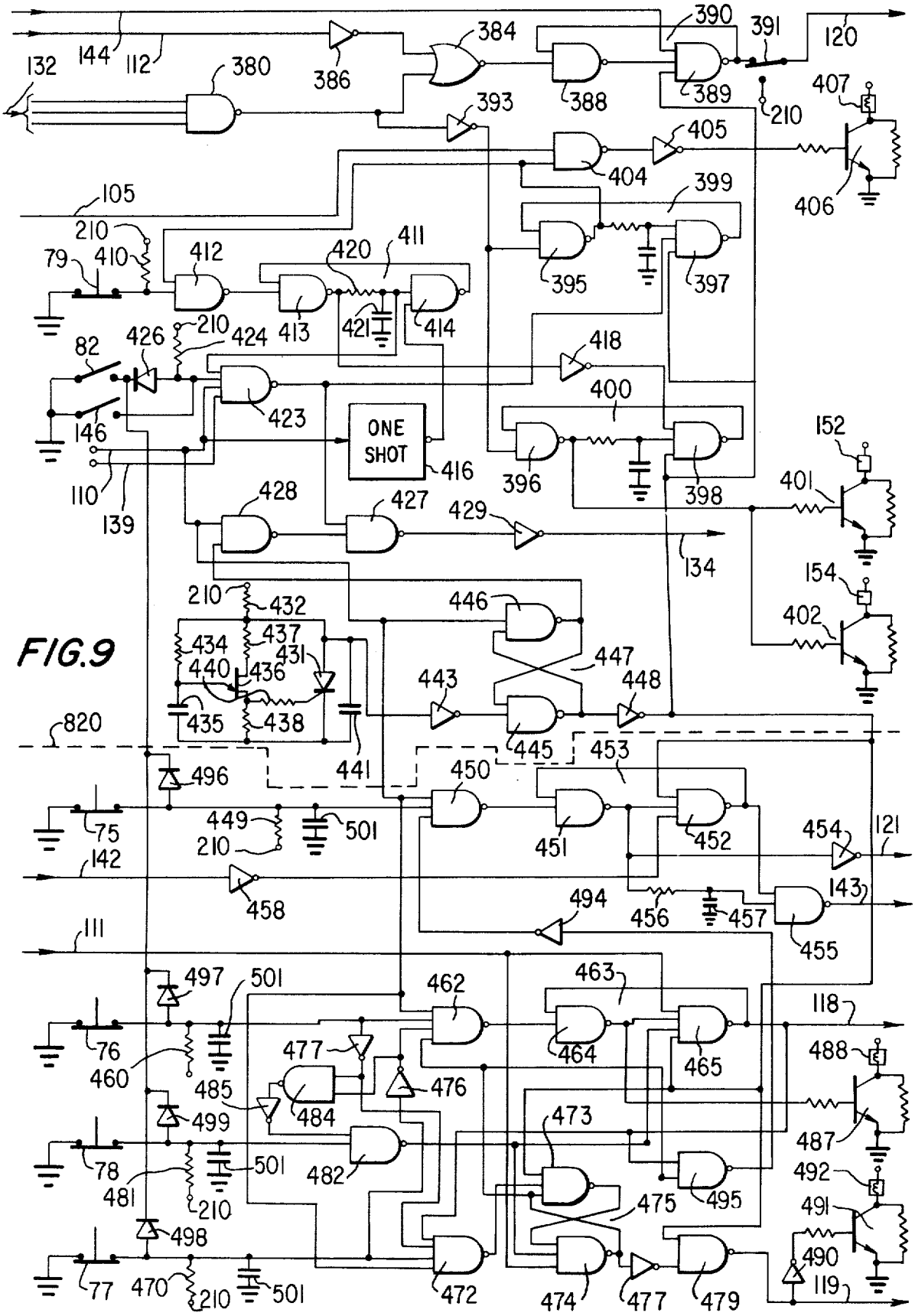
FIG. 9 is a diagram illustrating a function logic circuit of the circuitry of FIG. 2.

Function Logic Circuit (FIG. 9)

The function logic circuit 150 is shown in detail in FIG. 9. The lines 132 which carry the alarm pulses are connected to respective inputs of a nand gate 380. An inverter 386 connects line 112 to a one input of a nor gate 384 and the output of nand gate 380 is connected to another input of nor gate 384 to produce an output when an alarm pulse is present or when an alarm summary print pulse chain signal is present. The output of nor gate 384 is applied to an input of an nand gate 388 interconnected with a second nand gate 389 in a flip flop 390. The output of the nand gate 389 is connected by a switch 391 to the line 120 to produce a print cycle command signal when the flip flop 390 is activated. The flip flop 390 is reset by a print cycle reset signal on line 144 connected to an input of the nand gate 389. The switch 391 is provided to alternately connect the line 120 to the voltage source 210 in the event a printer is not included in the monitoring system and no printing functions are desired.

The output of the nand gate 380 is also connected by a inverter 393 to respective inputs of nand gates 395 and 396 interconnected with respective nand gates 397 and 398 in respective flip flops 399 and 400 to activate the flip flops 399 and 400 upon the receipt of an alarm pulse. The output of the nand gate 396 is connected to inputs of transistor amplifier circuits 401 and 402 which operate the respective alarm 152 and auxiliary relay 154. A nand gate 404 has one input connected to an output of the nand gate 395 and another input connected to the line 105 to drive an inverter 405 and transistor amplifier circuit 406 with a 1.5 hertz pulsating signal. The amplifier 406 operates a lamp 407 located behind a window in the alarm acknowledge switch 79 to provide a blinking light indicator when an alarm pulse has been received.

When the alarm acknowledge switch 79 is operated a voltage from the source 210 through a resistor 410 biases one input of a nand gate 412 which has its other input connected to the output of the nand gate 395. The output of the nand gate 412 connected to an input of nand gate 413 triggers a flip flop 411 containing interconnected nand gates 413 and 414. The flip flop 411 is reset by a pulse from a one shot 416 connected to an input of the nand gate 414 after a set signal on line 110 is applied to the one shot 416. The output of the nand gate 413 is connected by an inverter 418 to an input of nand gate 398 to reset the flip flop 400 and turn off the alarm 152 and auxiliary relay 154. The nand gates 413 and 414 have an interposed resistor 420 with a capacitor 421 connected to ground for the purpose of slowing the operation of the flip flop and rendering it less susceptible to noise signals. Similar resistances and capacitances are interposed in other flip flops within the circuitry and operate in a similar manner.

The output of nand gate 413 is connected through the resistor 420 to one input of a nand gate 423. A second input of the nand gate 423 is normally biased by a voltage through resistor 424 connected to the source 210. The second input is connected to the normally open panel switch 146 and by a diode 426 to the normally open lock switch 82. When either of the switches 82 or 146 are operated, the nand gate 423 is disabled. Also a set signal must be present on line 110 connected to a third input of the nand gate 423, and a fourth input connected to the line 139 must not be grounded by the lamp test switch to enable the operation of the nand gate 423. The output of the nand gate 423 is connected to an input of nand gate 397 to reset the flip flop 399 to terminate the blinking light 407 in the alarm acknowledge switch. Also the output of nand gate 423 is applied to an input of nand gate 427 which is normally enabled by a signal on another input from a nand gate 428. The output of nand gate 427 is connected by inverter 429 to the line 134 to produce an alarm acknowledge signal.

In the event of a power failure on the circuitry of the monitoring system, a silicon controlled rectifier 431 connected in series with a resistor 432 to the power source 210 will be rendered non-conductive. When power is again initiated, the voltage across the non-conductive silicon controlled rectifier 431 is applied by a resistor 434 across a capacitor 435 which is connected across a control electrode of a unijunction transistor 436. The unijunction transistor 436 is connected in series with resistors 437 and 438 across the silicon controlled rectifier 431. The capacitor 435 charges over a predetermined duration of time to trigger the unijunction transistor 436 to apply a pulse through a resistor 440 to a control electrode of the silicon controlled rectifier 431 to trigger the silicon controlled rectifier 431. A capacitor 441 connected across the silicon controlled rectifier 431 serves to eliminate high frequency signals which may be produced by the triggering of the silicon controlled rectifier 431. The output across the capacitor 441 is connected by an inverter 443 to an input of a nand gate 445 interconnected with a nand gate 446 in a flip flop 447. The output of the nand gate 445 is connected by an inverter 448 to inputs of nand gates 389, 397 and 398 to disable the flip flops 390, 399 and 400 when the power is initially turned on. The output of nand gate 446 is connected to one input of the nand gate 428, and the line 110 is connected to another input of nand gate 428 to produce alarm acknowledge signals on line 134 during the time that the silicon controlled rectifier 431 is non-conductive.

The force print push button 75, when operated, disconnects ground from an input of a nand gate 450 and allows that input to be biased by voltage from a resistor 449 connected to the source 210. A second input of the nand gate 450 is connected to the line 110 to apply a signal from the output of gate 450 during a set signal to an input of a nand gate 451 interconnected with a nand gate 452 in a flip flop 453. The output of the nand gate 451 is applied by an inverter 454 to the line 121 to produce a force print signal thereon. The output of the nand gate 452 is applied to one input of a nand gate 455 while the output of the nand gate 451 is applied through a delay circuit of a resistor 456 and capacitor 457 to another input of nand gate 455 to produce a force feed signal on line 143 at the end of the force print signal on line 121. The operation of the flip flop 453 is reset by the termination of a busy command signal on line 142 connected by an inverter 459 to an input of the nand gate 452.

Alarm summary switch 76 when operated disconnects ground and allows a voltage from the source 210 through a resistor 460 to be applied to an input of a nand gate 462. The line 110 is connected to another input of the nand gate 462 which applies a signal to an input of a nand gate 464 interconnected with a nand gate 465 in a flip flop 463 to produce an alarm summary command signal on line 118. Similarly for an alarm status summary, operation of the switch 77 allows a voltage from the source 210 to be applied by a resistor 470 to one input of a nand gate 472. A set signal on the line 110 connected to another input of the nand gate 472 triggers a flip flop 475 which includes a nand gate 473 interconnected with a nand gate 474 to produce an alarm status summary command signal on line 119 through an inverter 477 and a nand gate 479. The output of the nand gate 474 is connected to an input of the nand gate 462 to prevent the generation of an alarm summary command signal when an alarm status summary command signal is being produced. Similarly, the output of the nand gate 465 is connected to an input of the nand gate 472 to disable the production of an alarm status summary command signal when an alarm summary command signal is being produced. An invertor 476 connects the switch 77 to an input of the nand gate 462 and an invertor 477 connects the switch 76 to an input of the nand gate 472 to prevent the simultaneous operation of the switches 76 and 77 operating both flip flops 463 and 475 to simultaneously produce alarm summary command signals and alarm status summary command signals.

The alarm summary command signal on line 118 and the alarm status summary command signal on line 119 may be terminated by operating the switch 78 which allows a voltage from the source 210 to be applied by a resistor 481 to an input of a nand gate 482. The output of the nand gate 482 is applied to respective inputs of the nand gates 465 and 474 to reset the flip flops 463 and 475. When not terminated by a summary termination signal from the switch 78, the flip flops 463 and 475 are reset by a summary reset signal on the line 111 connected to inputs of the nand gates 465 and 474. The outputs of the inverters 476 and 477 are applied to respective inputs of a nand gate 484 which has its output connected by an inverter 485 to an input of the nand gate 482 to prevent operation of the nand gate 482 if either of the switches 76 or 77 are simultaneously operated. The output of the nand gate 464 is applied to a transistor amplifier 487 which operates a lamp 488 located behind a window of the switch 76 to light the switch and indicate the presence of an alarm summary command signal. Similarly the output of the nand gate 479 is applied by an inverter 490 to the input of a transistor amplifier 491 which operates a lamp 492 located behind a window in the switch 77 to light the switch 77 and indicate the presence of an alarm status summary command signal. The outputs of the nand gates 465 and 474 are connected to respective inputs of a nand gate 495 which has an output connected by inverter 494 to nand gate 450 to prevent the production of a force print signal on the line 121 when either an alarm summary command signal or an alarm status summary command signal is being produced on either of the lines 118 or 119.

The lock switch 82 is connected by diodes 496, 497, 498, and 499 to one side of the respective switches 75, 76, 77 and 78 to maintain a ground signal on inputs of the respective nand gates 450, 462, 472 and 482 and prevent the production of a force print signal on line 121, an alarm summary command signal on the line 118 and an alarm status summary command signal on the line 119 when the lock switch 82 is operated. Also the power off delay signal from the inverter 448 is applied to respective inputs of the nand gates 452, 465, 473 and 479 to prevent the force feed signal, alarm summary command signal and alarm status summary command signal for the predetermined duration after power is reapplied and to operate the flip flop 475 to initiate an alarm status summary print out. Capacitors 501–501 connected to respective switches 75–78 help prevent operation of the nand gates 450, 462, 472 and 482 by induced noise signals or the like.

Figure 10:
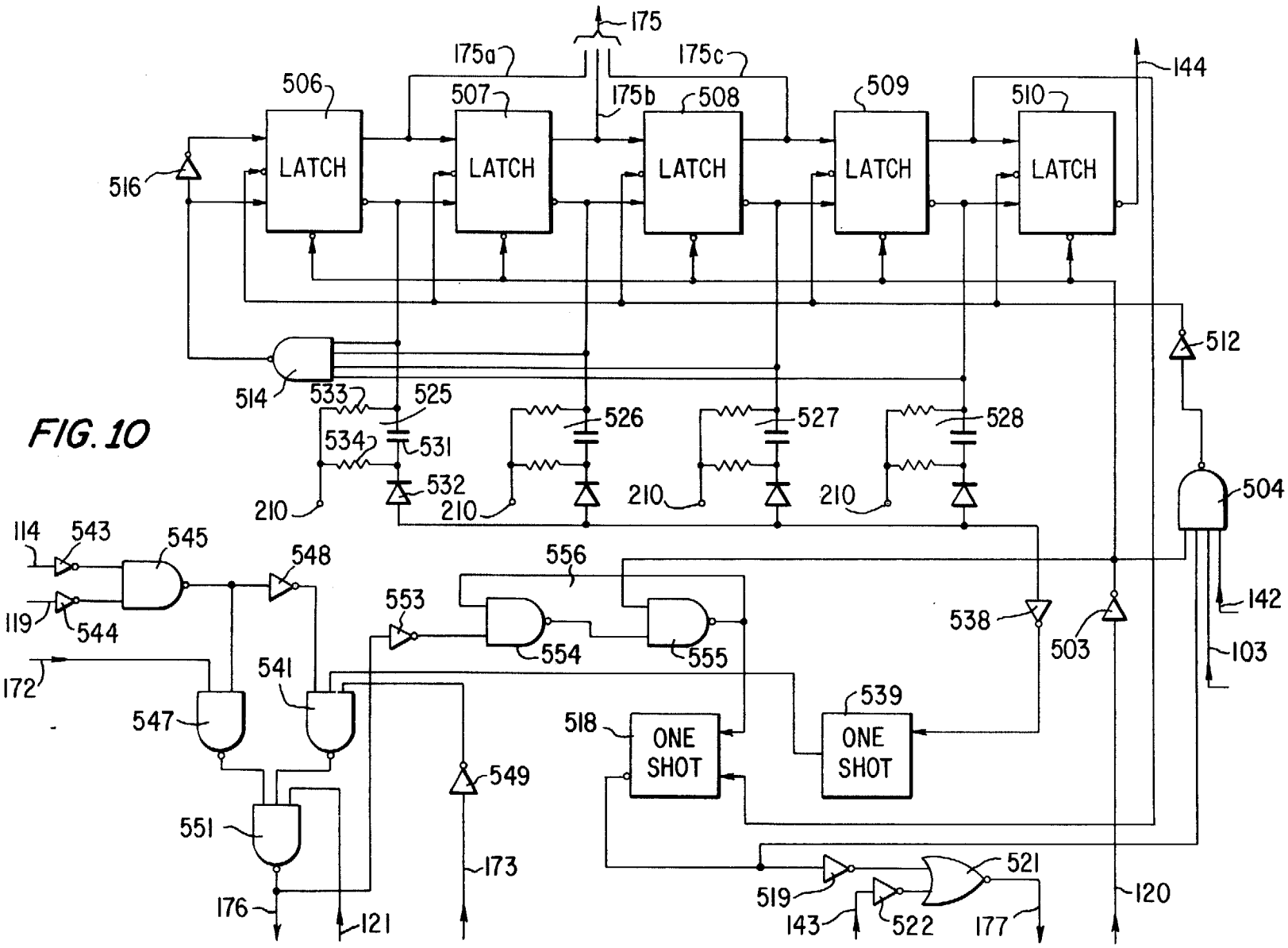
FIG. 10 is a diagram of a printer sequencing circuit which is employed in controlling the printing operation of the circuitry shown in FIG. 2.

Printer Sequencing Circuit (FIG. 10)

Upon the production of a print cycle command signal on line 120 by the function logic circuit 150, the printer sequencing circuit shown in detail in FIG. 10 is enabled. The print cycle command on line 120 is applied by an inverter 503 to an input on a nand gate 504 and a plurality of enable or reset inputs on latches 506–510. First phase clock signals on line 103 connected to an input of the nand gate 504 are applied by an inverter 512 connected to the output of gate 504 to transfer inputs of the latches 506–510. A nand gate 514 has inputs connected to the inverted outputs of latches 506–509 for applying input signals to an input of the first latch 506 when there is absence of signals stored in any of the latches 506–509. Another input of the latch 506 is connected to the output of the nand gate 514 by an inverter 516. The outputs of the latches 506, 507 and 508 are connected to the respective lines **175*a*, 175*b* and 175*c* to produce sequential point scanning signals on the lines 175 as the signal stored initially in the first latch 506 is sequentially moved down the latches to latch 510 by succeeding cycles of the first phase signal. The output of the latch 509 is connected to an input of a one shot 518 to produce an output pulse thereon which is applied by an inverter 519 to an input of a nor gate 521. The other input of the nor gate 521 is connected to the line 143 by an inverter 522 to produce a paper feed signal on the line 177 connected to the output of nor gate 521** when ever the one shot 518 is activated or a force feed signal is present on the line 143. Additionally the output of the one shot 518 is applied to an input of the nand gate 504 to prevent sequencing of the latches 506–510. Also a busy command signal on the line 142 connected to an input of the nand gate 504 disables the nand gate 504.

Inverted outputs of the latches 506–509 are applied to respective substantially identical differentiator circuits 525–528. The differentiator circuit 525 has a serially connected capacitor 531 and diode 532 with a pair of resistors 533 and 534 connecting the voltage source 210 to opposite sides of the capacitor 531. The outputs of all the differential circuits 525–528 are connected by an inverter 538 to an input of a one shot 539. The one shot 539 produces a slightly delayed pulse which has a duration which is less than one cycle of the clock signal on the line 142. A memory hold signal on the line 114 and a alarm status summary command signal on line 119 are applied by respective inverters 543 and 544 to inputs of a nand gate 545. The output of the nand gate 545 is applied to an input of a nand gate 547 to disable the nand gate 547 which has a second input from the line 172 which receives the alarm print command signal. The output of the nand gate 545 is also applied by an inverter 548 to an input of a nand gate 541 which has a second input connected to the output of the one shot 539 and a third input connected by an inverter 549 to the line 173 which receives the print command inhibit signal. The outputs of nand gates 541 and 547 along with the line 121 are connected to respective inputs of a nand gate 551 which produces a print command signal when (a) an alarm print command signal is present and memory hold and alarm-status summary command signals are not present, (b) a memory hold signal, an alarm status summary signal and a pulse from one of the differentiators 525–528 are present and a print command inhibit signal on line 173 is not present or (c) a force print command signal is present on line 121. The print command signal on line 176 is also applied by a inverter 553 to an input of an nand gate 554 which is interconnected with a nand gate 555 in a flip flop 556. The flip flop 556 is enabled by the presence of a print cycle command signal from the output of the inverter 503 connected to an input of the nand gate 555 to apply a signal to the one shot 518 and produce a paper feed signal on the line 177.

Print Inhibit Circuit (FIG. 11)

Referring now to FIG. 11 there is shown the details of the print inhibit circuit 157 of FIG. 2. The lines 138 receiving the acknowledged alarm signals are connected to respective first inputs of nand gates 558–566. The line 109a is connected to second inputs of nand gates 558–560, the line 109*b* is connected to second inputs of the nand gates 561–563 and the line 109*c* is connected to second inputs of the nand gates 564–566 to gate the acknowledged alarm signals with the respective station selection signals. The outputs of the nand gates 558–566 are connected by respective inverters 569–577 to first inputs of nand gates 579–587. The second inputs of the nand gates 579–587 are connected to the line 114 which receives the memory hold signal to disable the gates 579–587. The outputs of the nand gates 579, 582 and 585 are connected by an inverter 588 to the line 161*a*, the outputs of the nand gates 580, 583 and 586 are connected by an inverter 589 to the line 161*b* and the outputs of the nand gates 581, 584 and 587 are connected by the inverter 590 to the line 161*c* to produce inhibit signals on the respective lines 161 when a station selection signal corresponds to a row of memory units of which one respective unit is producing an acknowledged alarm signal during an alarm pulse initiated printing cycle.

Figure 12:
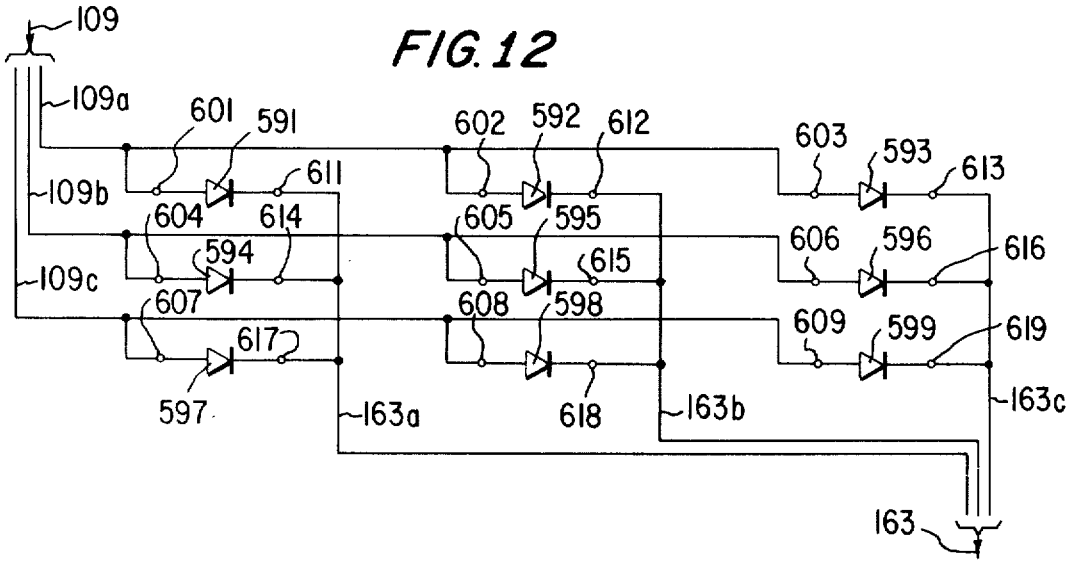
FIG. 12 is a diagram of an alarm program matrix circuit of the circuitry of FIG. 2.

Alarm Program Matrix Circuit (FIG. 12)

FIG. 12 shows in detail the alarm program matrix circuit 159 of FIG. 2. The circuit has a plurality of diodes 591–599 which have anodes connected to respective terminals 601–609 and cathodes connected to respective terminals 611–619. The terminals 601–603 are connected to the line 109*a*, the terminals 604–606 are connected to line 109*b* and the terminals 607–609 are connected to line 109*c* to receive respective station selection signals. The terminals 611, 614, and 617 are connected to the line 163*a*, the terminals 612, 615, and 618 are connected to the line 163*b* and the terminals 613, 616 and 619 are connected to the line 163*c* to produce alarm enable signals on the respective lines 163. The alarm program matrix may be programmed by removing one or more of the diodes 591–599 from between the respective terminals 601–609 and 611–619 in accordance with desired status points to be monitored. Then, only the remaining diodes will produce alarm enable signals on the lines 163 in accordance with alarm points being monitored.

Alarm Status Program Print Decoder Circuit (FIG. 13)

Referring now to FIG. 13 there is shown in detail the alarm status print decoder 178 of FIG. 2. The lines 128 are connected to inputs of respective latch circuits 624–626. The data signals on the lines 128 are indexed into the respective latches 624–626 when a print cycle command is present on the line 120 which is connected to other inputs of the latches 624–626. The inverse outputs of the latches 624, 625, and 626 are connected to first inputs of respepctive nand gates 628, 629 and 630, the lines 175*a*, 175*b*, 175*c* are applied to second inputs of the respective nand gates 628, 629, and 630 and the lines 163*a*, 163*b* and 163*c* are connected to third inputs of the respective nand gates 628, 629 and 630. The outputs of the nand gates 628–630 are connected to respective inputs of a nand gate 632 which produces a print command inhibit signal on line 173 when a point scanning signal on the lines 175 coincides with a point on one of the lines 128 which has no data signal and the point is programmed for a alarm point. The outputs of the latches 624–626 are applied to inputs of respective nand gates 634–636 while other inputs of the respective nand gates 634–636 are connected to respective point scanning lines 175*a*–175*c* and respective inhibit lines 161*a*–161*c*. The outputs of the nand gates 634–636 are applied to respective inputs of a nand gate 638 which produces an output signal upon the presence of a scanned data signal which does not correspond to an acknowledged alarm signal during an alarm pulse initiated printing cycle. The outputs of the nand gates 634–636 are also applied by respective inverters 640–642 to first inputs of nand gates 644–646. Second inputs of the nand gates 644–646 are connected to the respective lines 163*a*–163*c* to produce output signals on the gates 644–646 when a non-inhibited scanned data signal corresponds to an alarm point. The output of the nand gates 644–646 are connected to respective inputs of a nand gate 648 which produces a red print signal on the line 181. Also the red print signal is applied to an input of a nor gate 649 along with the output of the nand gate 648 to produce an on-off command signal on the line 179. Differentiating circuits 652–654 are connected to outputs of respective nand gates 644–646. The differentiating circuit 652 has a serially connected capacitor 656 and diode 657 with a pair of resistors 658 and 659 applying a voltage bias from the source 210 on both sides of the capacitor 656. The output of the differentiators 652–654 are summed by an inverter 655 to produce an alarm print command signal on the line 172.

Figure 14:
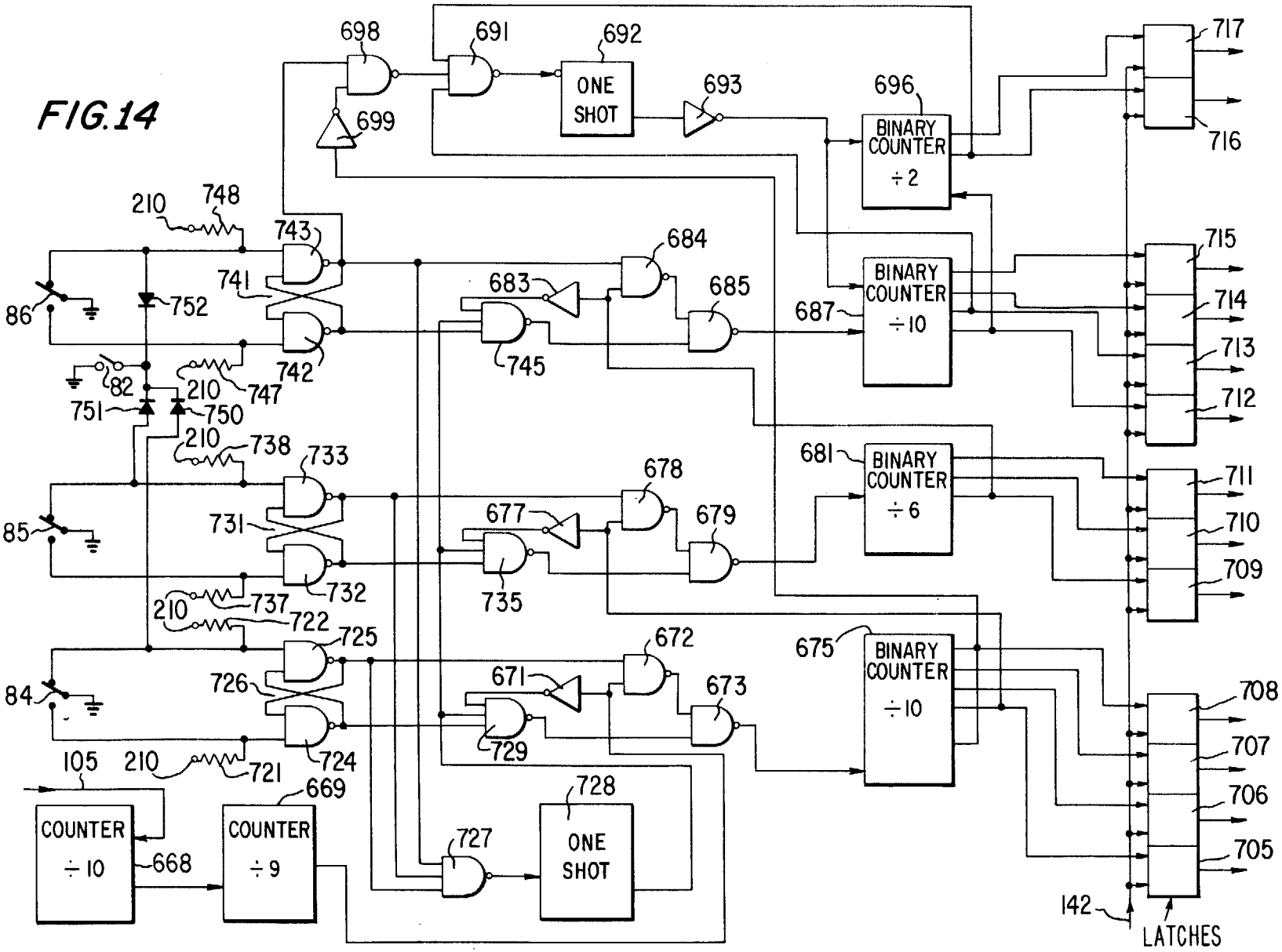
FIG. 14 is a circuit diagram of a 24-hour clock circuit used in the circuitry of FIG. 2.

24 Hour Clock Circuit (FIG. 14)

In FIG. 14 there is shown the details of the 24-hour clock circuit. The line 105 with the 1.5 hertz clock signal is connected to an input of a counting circuit 668 which is designed to count 0–9. The output of the counter 668, which produces a signal when the counter cycles from 9 to 0, is connected to an input of a counter 669 which is designed to count from 0 to 8. The output of the counter 669 which produces a signal when the counter 669 cycles to 0 is connected through a nand gate 672 and a nand gate 673 to an input of a binary counter 675 which is design to count from 0 to 9. An output of the counter 675 which produces a signal when the counter cycles from 9 to 0 is applied through nand gates 678 and 679 to an input of a binary counter 681 designed to count from 0 to 5. The output of the counter 681 which produces a signal at the 0 signal is connected through nand gates 684 and 685 to an input of a binary counter 687 which is designed to count from 0 to 9. The output of the counter 687 which produces a signal when the counter 687 cycles from 9 to 0 is applied to an input of the counter 696 to advance the counter 696. An output of the counter 675 which produces a signal when the count is 1 is connected through an inverter 699 to an input of a nand gate 698. Another input of the nand gate 691 is connected to an output of the counter 687 which produces a signal when the count is 4 but no signal when the count is less than 4. Still another input of the nand gate 691 is connected to an output of the counter 696 which produce a signal when the count is 2 but no signal when the count is less than 2. The output of nand gate 691 is connected to an input of a one shot 692 which has an output connected by an inverter 693 to reset inputs of counter 696 and 687 to reset the clock to 00 hours and 01 minutes when the clock reaches 24 hours and 01 minutes. Binary outputs of the counters 675, 681, 687 and 696 are connected to first inputs of respective latch circuits 705–717. Second inputs of the latches 705–717 are connected to the line 142 to disable the first latch inputs when a busy command signal is present. The outputs of the latches 705–717 provide time information to the printer 89 of FIG. 1. Switches 84–86 are provided to advance the respective counters 675, 681 and 687 manually to set the clock circuit. The switch 84 selectively grounds inputs of nand gates 724 and 725 interconnected as a flip flop 726. The inputs are biased by resistors 721 and 722 from the source 210. The output of the nand gate 725 is connected to an input of the nand gate 727 to apply a signal to a one shot 728. The output of the nand gate 724 is connected to a nand gate 729 to enable the nand gate 729. The output of the one shot 728 is connected to a second input of the nand gate 729 which produces an output pulse applied through nand gate 673 to advance the counter 675. The nand gate 729 has a third input which is connected by an inverter 671 to the output of the counter 669 to prevent operation during the presence of a signal from the counter 669. Similarly there are provided the switch 85, a flip flop 731 containing nand gates 732 and 733, an inverter 677, resistors 737 and 738 and a nand gate 735 to advance the counter 681; and the switch 86, a flip flop 741 containing a nand gate 742 and 743, an inverter 683, resistors 747 and 748 and a nand gate 745 to advance the counter 687. Also the output of the nand gate 743 is applied to an input of the nand gate 698 to enable the operation of nand gate 691 while the switch 86 is operated to reset the counters 687 and 696 to read 00 when they change to 24. The key switch 82 is connected by respective diodes 750, 751, and 752 to inputs of the nand gates 725, 733 and 743 to disable operation of the switches 84–86 when the key switch 82 is operated.

Figure 17:
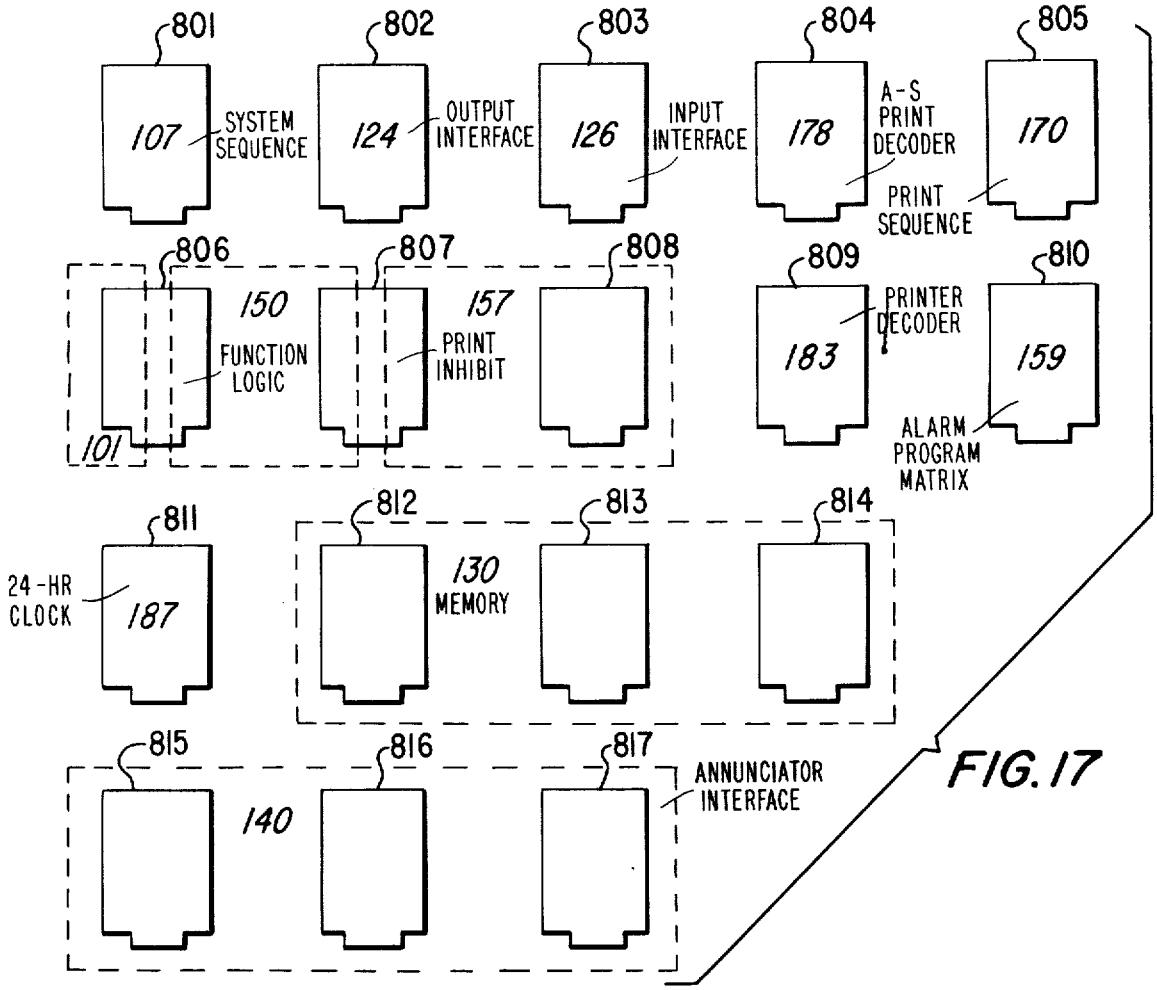
FIGS. 17 and 18 illustrate the modular construction of the circuitry of FIGS. 2–14.
Figure 18:
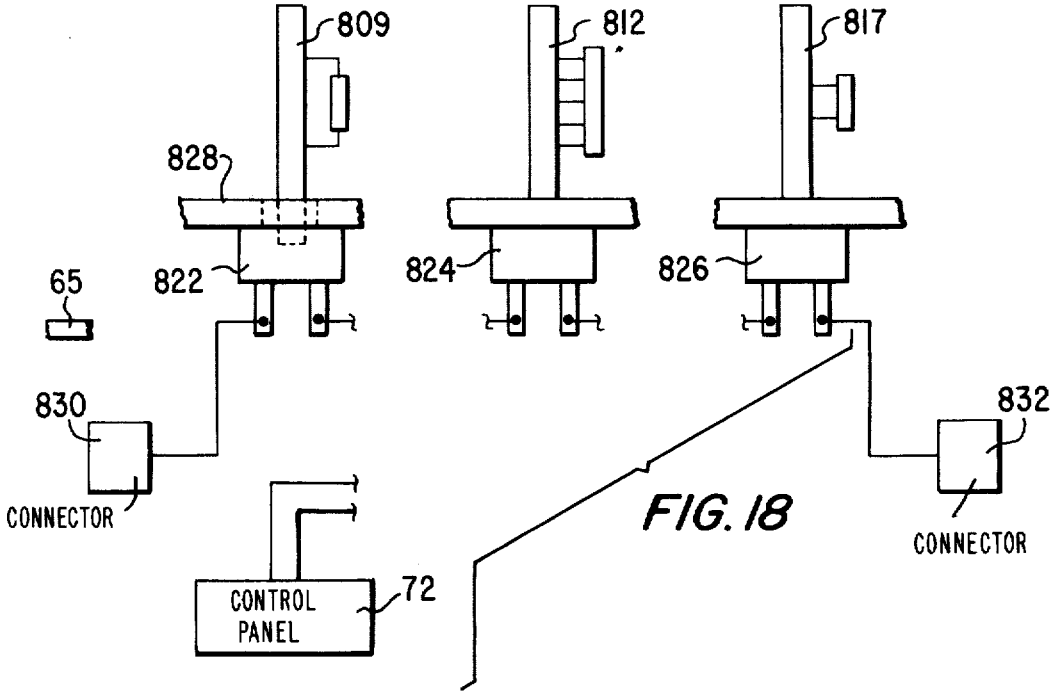

Modular Structure and Variations (FIGS. 17 and 18)

Most of the circuitry in FIGS. 2–14 is made in modular units or printed circuit modules 801–817 as shown in FIG. 17. Printed circuit modules 801–805 and 809–811 respectively contain the system sequencing circuit 107, the output interface circuit 124, the input interface circuit 126, the alarm status print decoder circuit 178, the printer sequencing circuit 170, the printer decoder circuit 183, the alarm program matrix circuit 159 and the 24-hour clock circuit 187. The system clock circuit 101 is formed on a portion of the printed circuit module 806 which also contains a portion of the function logic circuit 150 common to both printing and annunciation functions, namely, all the circuitry shown above the dashed line 820 in FIG. 9. The function logic circuitry below the dashed line 820 is devoted to printing functions and is contained in a portion of the printed circuit module 807 which also contains a portion of the print inhibit circuit associated with the first station 37 (FIG. 1), namely, in FIG. 11, nand gates 558–560 and 579–581 and inverters 569–571 and 588–590. The remaining print inhibit circuitry solely associated with the second and third stations 38 and 39 is contained in printed circuit module 808. The printed circuit modules 812–814 contains the circuitry of the respective rows of memory units 322–330 in the memory 130 corresponding to respective stations. Similarly, the printed circuit modules 815–817 contain the annunciator interface circuitry associated with respective stations.

All the printed circuit modules 801–817 are removably connected to suitable connectors such as, for example shown in FIG. 18, the printed circuit modules 809, 812 and 817 connected to the respective printed circuit connectors 822, 824 and 826 mounted on a frame 828. Suitable wiring, in accordance with the circuitry illustrated in FIGS. 2–14, electrically interconnects terminals of the connectors, suitable power sources in panel 93 (FIG. 1), the cable 65, the control panel 72, a connector 830 for connecting to the printer 89 (FIG. 1) and a connector 832 for connecting to the annunciator panel 68 (FIG. 1).

Hereinbefore, there has been described an alarm and status monitoring system employing both an annunciator 68 and a printer 89 for indicating conditions. However, an alarm and status monitoring system may include an annunciator 68 without a printer 89, or a system may include a printer 89 without an annunciator 68. However all systems conveniently employ substantially identical frames with wired connectors.

For a system containing only an annunciator panel 68 and no printer 89, only the printed circuit modules 801–803, 806, and 812–817 are employed with the printed circuit modules 804, 805 and 807–811 being absent. Additionally, there would be substituted a different control panel 72 which contains only the alarm acknowledge switch 79 and the lamp test switch 80. Also, the switch 391 is operated.

For a system containing only a printer 89 and no annunciator panel 68, only the printed circuit modules 801–814 are employed with the printed circuit modules 815-817 being absent. Also, a different control panel 72 containing only the switches 75–79 and 84–86 would be employed, the switch 80 being absent.

In addition to being readily adaptable for three different systems, any of the systems can be readily adopted to monitor less than nine condition points. For example, for only six points, none of the systems would employ the printed circuit modules 814 and 817, thus providing a less expensive system. Eliminating any of the printed circuit modules 812–814 requires the simple jumpering of the connector terminal connected to the disconnected one of the lines 132 to a terminal providing a suitable bias to allow proper operation of the nand gate 380 (FIG. 9).

A typical system having a capacity to monitor one hundred and four points arranged in thirteen stations with eight points apiece, only nine points herein described, has great flexibility and many advantages. One such advantage of the modular construction of the system is that a much larger capacity system then immediately required by the user may be purchased saving the expense of unnecessary components. As needs expand, printed circuit modules may be readily added to meet the new requirements without having to replace the system. Similarly, a system employing only an annunciator panel may be readily modified by adding a printer, the printed circuit modules 804, 805 and 807-811, and the control panel 72 with all the switches 75-86. Or, a system employing only a printer may be readily modified by adding an annunciator panel, the printed circuit modules 815–817 and the control panel 72 with all the switches 75–80 and 84–86.

Operation

Since the operation of a system employing only an annunciator and the operation of a system employing only a printer are substantially identical to the operation of the respective annunciator portions and printer portions of a system employing both an annunciator and a printer, only the operation of a system employing both an annunciator and a printer is hereinafter described.

Referring to FIG. 1, when an alarm condition or status condition occurs one of the contacts 20–28 will be closed to indicate that the condition has occured. Station selection signals on respective lines **40*a*, 40*b*, and 40*c* are applied sequentially to the first group of contacts 20–22, to the second group of contacts 23–25 and to the third group of contacts 26–28. When one of the switches 20–28 has been closed by an alarm or a status condition, a station selection signal is passed by the closed contact to produce a data signal on one of the lines 60*a*, 60*b* or 60*c*** in accordance with whether it was a first, second or third contact of each group of contacts.

The generation of a data signal indicating an alarm condition operates the lamp 370 (FIG. 8) behind one of the annunciator windows 70 with a flashing or blinking light, an audible alarm 152 (FIGS. 2 and 9) and a lamp 407 (FIG. 9) behind the alarm acknowledge switch 79 with a flashing light. An operator may terminate the operation of the audible alarm 152 and the lamp 407 behind the alarm acknowledge switch 79 and change the flashing lamp 370 of the annunciator panel 70 from a flashing indication into a steady lighted indication by depressing the alarm acknowledge switch 79. When a data signal corresponding to a programmed status point or condition is generated, the lamp 370 behind one of the annunciator windows 70 is operated with a steady light and the lamp 407 and alarm 152 remain unoperated.

Each time a data signal corresponding to an alarm condition is received characters are printed in red on a paper tape by the printer 89 identifying the alarm point or contact which has operated. Additionally, the printer 98 may be commanded to print a summary of all existing alarm conditions by operating the alarm summary switch 76, or the operator may command a summary of all the alarm conditions and the on-off condition of all status points by pressing the alarm status memory switch 77. The alarm summary or the alarm status summary being printed by the printer 89 may be terminated by pressing the summary cancel switch 78.

In addition to printing the location of the alarm conditions or status conditions the printer also prints the time that the condition occured. A force print switch 75 may be operated to cause the printer 89 to print only the time. One of the switches 84–86 may then be operated to advance the minutes, 10 minutes or hour of a 24-hour clock 187 (FIG. 2) until it is properly set.

One of the advantages of the invention is the provision of the key switch 82 which prevents an unauthorized person from operating or terminating the proper operation of the system. When operated the key switch 82 prevents an unauthorized person from turning off the flashing lamps in the annunciator panel 70 and the flashing lamp 407 of the alarm acknowledge switch 79. Operation of the alarm acknowledge switch 79, however, will turn off the audible alarm 152. In addition the operation of the key switch 82 disables the operation of the force print switch 75, the alarm summary switch 76, the alarm status summary switch 77, the summary cancel switch 78 and the clock setting switches 84, 85 and 86.

Figure 16:
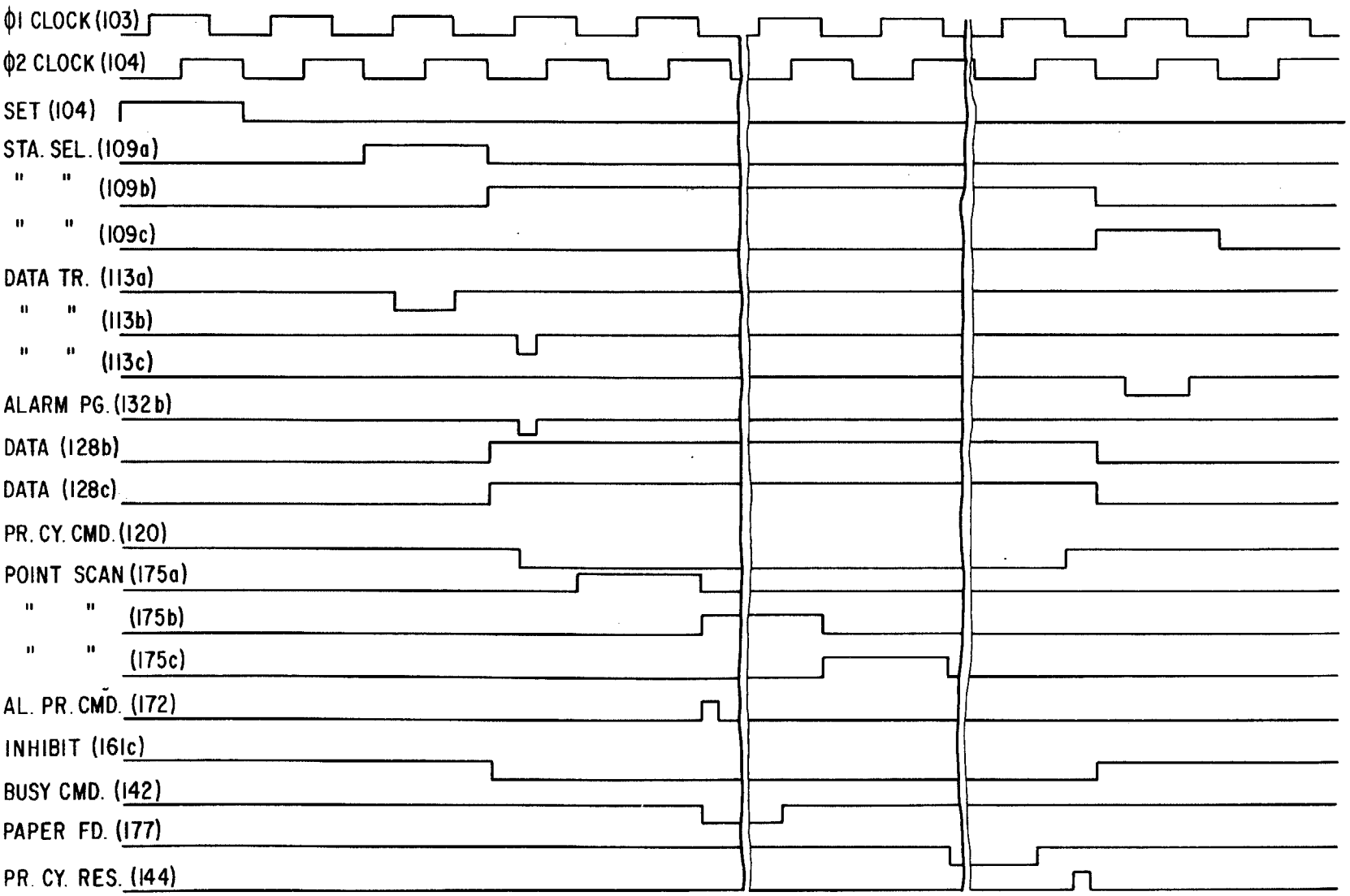
FIG. 16 is a time chart showing signals produced on various points of the monitoring system during an alarm sensing operation.

A general understanding of the operation of the circuitry in FIG. 2 may be inhanced by reference to the waveforms illustrated in FIGS. 15 and 16. The general timing of the circuitry is controlled by a system clock 101 which produces first and second phase 30 hertz clock signals on the respective lines 103 and 104. Also the clock 101 produces a 1.5 hertz signal on line 105 which is used by the annunciator interface circuit 140 and the function logic circuit 150 to produce the flashing light signals. Also, the 1.5 hertz signal controls the operation of the 24-hour clock circuit 187.

The system sequencing circuit 107 generates a series of four sequential signals. The first signal is the set signal on line 110 which is followed by the three sequential station selection signals on the respective lines **109*a*, 109*b*, and 109*c*. The relative timing of the set signal and the station selection signals is illustrated in FIG. 15. The output interface circuit 124 amplifies the station selection signals and applies them to the respective lines 40*a*, 40*b* and 40*c* of FIG. 1. In the event that one of the contacts 20–28 are closed, the resulting data signal on one of the lines 60 is applied by the input interface 126 to the lines 128 and hence to the memory 130. The system sequencing circuit 107 applies sequential data transfer signals on respective lines 113** to store the data signal in units or locations of the memory corresponding to each of the points being monitored.

In the event a data signal on one of the lines 128 comes from a contact 20–28 which corresponds to an alarm point and the corresponding memory unit has no previously stored data signal, an alarm pulse signal is generated on one of the lines 132 and applied to the function logic circuit 150. This causes the ringing of the alarm 152, the operation of the relay 154 along with the flashing light behind the alarm acknowledge switch 79. The memory 130 is programmed not to produce alarm pulse signals when the received data signals correspond to status points. In addition, stored data signals in the memory 130 produce alarm status signals on corresponding lines 136 which are applied to the annunciator interface circuit 140. The annunciator interface circuit 140 is programmed so that alarm status signals corresponding to alarm points, prior to acknowledgement, causes the flashing of the corresponding lamps on the annunciator panel 68 while alarm status signals corresponding to status points continuously light the corresponding lamps. An authorized operator, hearing the alarm 152 and seeing the flashing lights in the alarm acknowledge switch 79 and the annunciator 68, may operate the alarm acknowledge switch 79 to acknowledge the receipt of the alarm signal. Operating the switch 79 activates the function logic circuit 150 to stop the alarm 152, to extinguish the alarm acknowledge switch lamp and to produce an alarm acknowledge signal on line 134 which is applied to the memory circuit 130 to store additional information that the stored data signal has been acknowledged. Once the alarm signal has been acknowledged, an acknowledged alarm signal is produced on one of the lines 138 which is applied to the annunciator interface circuit 140 to change the flashing of the corresponding lamp to a steady lighted condition.

Also upon receipt of the alarm pulse signal, the function logic circuit 150 produces a print cycle command signal on line 120 which is applied to the system sequencing circuit 107. The print cycle command signal holds the system sequencing circuit 107 to continue the station selection signal on the respective line 109 connected to that group of contacts in FIG. 1 which has produced a data signal corresponding to an alarm point. The print cycle command signal on line 120 is also applied to the printer sequencing circuit 170 to start the production of sequential point scanning signals on the respective lines 175*a*, 175*b* and 175*c* as illustrated in FIG. 16. The point scanning signals are applied to the alarm status print decoder circuit 178 along with the data signals on lines 128. The alarm status print decoder circuit 178 produces an alarm print command signal on line 172, a red print signal on line 181 and an on-off command on line 179 when the point scanning signal corresponds to an unacknowledged alarm data signal. The alarm print command signal on line 172 is applied to the printer sequencing circuit 170 which applies a print command signal to the printer 89. The printer 89 produces a busy command signal on line 142 which is applied to the printer sequencing circuit 170 to hold the printer sequencing circuit to continue the point scanning signal which is producing the alarm print command signal. The printer decoder circuit 183 receives the on-off command on the line 179, the red print command on the line 181, the point scanning signals on lines 175 and the station selection signals on lines 109 and converts the information to an appropriate code on lines 185 to be received by the printer 89. Additionally the busy command on line 142 holds the outputs of the 24-hour clock circuit 187 so that the printer will not be effected by a change of time while it is performing a printing operation.

Once the printer 89 has completed the printing of the data, the busy command signal on line 142 is removed and the printer sequencing circuit 170 is allowed to continue producing the point scanning signals on lines 175. At the end of the point scanning signals, the printer sequencing circuit 170 applies a paper feed signal on line 177 to the printer 89 for a sufficient duration to feed a desired amount of paper through the printer 89. After the paper has been feed the printer sequencing circuit 170 than applies a print cycle reset signal to line 144 and the function logic circuit 150 to reset the logic circuit and remove the print cycle command signal from the line 120.

During the point scanning operation of the printer sequencing circuit 170 some of the data signals on the lines 128 may correspond to alarms which have been acknowledged or to status points. To prevent the printing of the acknowledged alarm signals, the print inhibit circuit 157 receives the acknowledged alarm signal on lines 138 along with the station selection signals on lines 109 to produce inhibit signals on lines 161 to prevent the alarm-status printer decoder 178 from producing the alarm print command signal on line 172, the on-off command signal on line 179 and the red print command signal on line 181. In addition, the alarm program matrix circuit 159 is appropriately programmed so that input signals on lines 109 produce alarm enable signals on lines 163 corresponding only to alarm points. The alarm enable signals on lines 163 only allow the alarm status print decoder circuit 178 to produce the alarm print command signal on line 172 and the red print command signal on line 181 when the scanned data signal corresponds to an alarm point.

The removal of the print cycle command on line 120 allows the system sequencing circuit 107 to again begin normal scanning functions and producing the set signal on line 110 and the sequential station selection signals on lines 109 until a new alarm pulse on lines 132 is produced.

In the event the operator wishes to have a print out of all existing alarm conditions including those which are acknowledged, the alarm summary switch 76 is operated to produce the alarm summary command signal on line 118. Similarly the operator may command a print out of all alarm conditions along with the status of all status points by operating the switch 77 to produce an alarm status summary command signal on line 119. Either the alarm summary command signal on line 118 or the alarm status summary command signal on line 119 causes the system sequencing circuit 107 to hold its station selection signal when it cycles to the first station selection signal on the line 109a. The system sequencing circuit 107 also produces a momentary alarm summary print pulse chain signal on line 112 which is applied to the function logic circuit 150. The alarm print pulse chain signal causes the function logic circuit 150 to produce the print cycle command signal on line 120 to initiate operation of the printer sequencing circuit 170. Also during an alarm summary or alarm status summary, the system sequencing circuit 107 produces a memory hold signal on line 114 which is applied to the memory 130 to prevent additional alarm or status signals being read into the memory 130 while a summary point scanning operation is being per-formed. Additionally the memory hold signal is applied (a) to the print inhibit circuit 157 to disable the inhibiting of acknowledged alarms and thus allow acknowledged alarm signals to be printed and (b) to the printer sequencing circuit 170 along with the alarm status summary command on line 119 to enable the printer sequencing circuit 170 to command the printing of status points as well as the alarm points only when an alarm status summary has been commanded. When the absence of a data signal on one of the lines 128 corresponds to a unoperated alarm point which is then being scanned, the alarm status printer decoder circuit 178 produces a print command inhibit signal on line 173 to the printer sequencing circuit 170 to prevent the printing of non-operated alarm points during either an alarm summary or an alarm status summary. During an alarm status summary the on-off condition of all status points is printed.

After all of the points corresponding to a station selected by the first station selection signal on the line 109*a* have been scanned by the printer sequencing circuit 170, the print cycle command signal on the line 120 is terminated and the system sequencing circuit 107 inserts a normal alarm scanning operation producing a cycle of all station selection signals to search all of the stations for new alarm conditions. An N print signal on line 115 causes the printer 89 to print N after any new alarm sensed during a summary. After the stations have been scanned in the normal fashion and any new claims recorded the system sequencing circuit 107 stops at the station selection signal on the line 109*b*. This again institutes the production of an alarm summary print pulse chain signal on line 112 which initiates another point scanning operation from the printer sequencing circuit 170 to continue printing either an alarm summary or an alarm status summary. The system sequencing circuit 107 continues in this fashion until all of the lines 109 have been subject to point scanning operations and the print out of an alarm summary or an alarm status summary has been completed. Then the system sequencing circuit 107 produces a summary reset signal on line 111 to the function logic circuit 150 to terminate the alarm summary command signal on line 118 or the alarm status summary command signal on line 119 to revert the system to normal operation.

During the alarm summary print out or the alarm status summary print out the operator may terminate the summary print out by pressing the summary cancel switch 78 which terminates the alarm summary command signal on the line 118 or the alarm status summary command signal on the line 119 to stop the alarm summary or alarm status summary operation after any print cycle is completed which may be in operation.

The operation of the system clock shown in FIG. 3 is controlled by a 60 cycle input signal which is half-wave rectified, shaped and formed before being applied to inputs of latches 228 and 232. The latches 228 and 232 are interconnected in a manner to produce the respective first and second phase 30 hertz signals on the lines 103 and 104. The first phase clock signal on the line 103 leads the second phase clock signal on the line 104 by 90° as illustrated in FIG. 15. Additionally the output of the latch 232 is divided by twenty by the serial connected counter circuit 234 and latch 236 to produce the 1.5 hertz signal on line 105.

Scanning operation of the system sequencing circuit shown in FIG. 4 is controlled by the 30 hertz clock signals on the lines 103 and 104. The second phase clock signal on line 104 sequentially steps or cycles the binary counter 244. The binary counter 244 operates the decoder circuit 246 which produces first the set signal on line 110 and then the sequential station selection signals on the lines 109*a*, 109*b*, and 109*c*. The sequential station selection signals are gated with the first phase clock signals on the line 103 to produce the sequential data transfer signals on the lines 113*a*, 113*b*, and 113*c*. Upon the receipt of a print cycle command signal on the line 120 or a force print signal on the line 121 the nand gate 240 disables the application of the second phase clock signal on the line 104 to the counter 244 to stop the counter 244 from advancing. Also the print cycle command signal on line 120 terminates the data transfer signals on the lines 113. After the print cycle command signal on the line 120 or the force print signal on the line 121 has been terminated the counter 244 is allowed to continue advancement and the production of the station selection signals on the lines 109 and the set signal on the line 110.

When an alarm summary command signal on line 118 or an alarm status summary command signal on line 119 is present, the binary counter 270 is enabled to receive the next set signal from the line 110 to advance the count to the number 1. The decoder circuit 272 produces the output of the binary counter 270 in parallel form which is gated with the data transfer signals on lines 113 to produce an alarm status print pulse chain signal on the line 112 when the data transfer signals on lines 113 correspond to the output of the decoder circuit 272. After a printer sequencing cycle and the completion of a cycle of the station selection signals, the next set signal advances the counter 270 to the number 2 so that in the next sequence of station selection signals the alarm status print pulse chain signal is produced when the data transfer signal on line 113*b* is produced. Thus it is seen that during the alarm summary or alarm status summary operations the system sequencing circuit enables successive point scanning cycles of the printer sequencing circuit 170 with a normal station scanning operation of the system sequencing circuit 107 interposed between each point scanning cycle to sense any new alarm conditions. During the interposed station scanning operations, the nand gate 285 produces the N print signal on line 115. The selector circuit 284 senses the coincidence of the count of the counter 270 with station scanning signals on lines 109 to produce the memory hold signal on the line 114. After the alarm summary or alarm status summary has been completed, the decoder circuit 272 produces the summary reset signal on line 111. The counter 270 is reset to 0 by the termination of the alarm summary command signal on the line 118 or the alarm status summary command signal on the line 119.

The output interface circuit 124 and the input interface circuit 126 serve to connect the circuitry of FIG. 2 with the cable 65 and the station boxes 37–39 of FIG. 1. As illustrated in FIG. 5 an amplifying and protection circuit is interposed between the lines 109*a* and 40*a* to increase the level of voltage signals on the line 40*a* while protecting line 109*a* from high voltage signals which may be picked up by the lines 40*a*. Similarly, the protective circuit shown in FIG. 6 interposed between the lines 60*a* and 128*a* serves to decrease the data signals from line 60*a* to an appropriate level on line 128*a* while protecting the line 128*a* from high voltages or extraneous noise signals which may be present on the line 60*a*.

Received data signals on lines 128*a*, 128*b*, and 128*c* are supplied to respective columns of the substantially identical memory units 322–330 as shown in FIG. 7. The data signals on the lines 128 are stored in respective rows of the units 322–330 by the data transfer signals on the respective lines 113*a*, 113*b*, and 113*c* when the nand gates 331–333 are enabled by the absence of a memory hold signal on line 111. Thus each of the memory units 322–330 correspond to a respective one of the points or contacts 20–28 of FIG. 1. In memory unit 322, the data signal is stored in latch 334. When the memory unit 322 is programmed to have a diode 342 connected between terminals 344 and 346 indicating that memory unit corresponds to an alarm point rather than a status point, an alarm pulse is produced on one of the lines 132 when a data signal is first stored in the respective latch 344. When an alarm acknowledge signal is applied to the line 134, the data signal stored in the latch 344 is also stored in the latch 348. The latch 334 produces alarm status signals on the respective line 136*a* while the latch 348 produces acknowledge alarm or status signals on the line 138*a*.

As illustrated for the lines 138*a* and 136*a* and 141*a* in FIG. 8, the annunciator interface circuit receives the alarm status signals on the line 136*a* and the acknowledge alarm signals on the line 138*a* to operate the lamp 370. If the circuit is programmed by the strap 362 connected between terminals 360 and 364 to indicate an alarm point, the application of an alarm status signal on lines 136 causes the lamp 370 to blink at a 1.5 hertz rate. When the corresponding acknowledged alarm signal is present on line 138*a*, the blinking is stopped and the lamp 370 is lit continuously to indicate the presence of a acknowledged alarm. In the event the circuit is programmed by connecting the strap 362 between the terminals 360 and 374 to indicate a status point rather than an alarm point, the lamp 370 is lit continuously rather than blinking upon the receipt of an alarm status signal on the line 138*a*.

The function logic circuit in FIG. 9 produces various controlling signals in response to various input signals or the operation of one of the switches 75–80. The receipt of an alarm pulse signal on one of the lines 132 or the receipt of a alarm summary print pulse chain signal on the line 112 operates the flip flop 390 to produce the print cycle command signal on the line 120. After a printing cycle is completed the flip flop 390 is reset by a print cycle reset signal on the line 144. The receipt of a alarm pulse signal on one of the lines 132 also operates two flip flops 399 and 400. Operation of the flip flop 400 activates the audible alarm 152 and the auxiliary relay 154. The flip flop 399 and the 1.5 hertz signal on the line 105 operate the flashing light 407 located in the alarm acknowledge switch 79. When the alarm acknowledge switch 79 is operated, the flip flop 411 is activated which resets the flip flop 400 to terminate the operation of the audible alarm 152 and the auxiliary relay 154. The flip flop 411 also applies a signal to a nand gate 423. The nand gate 423 also receives inputs from the respective key lock switch 82, panel lock switch 146, the set signal on the line 110, and the lamp test signal on the line 139 so that the nand gate 423 is operated only when the switches 82 and 146 are open, the lamp test switch 80 is unoperated and a set signal is present on the line 110. The nand gate 423 then produces an alarm acknowledge signal on the line 134 and resets the flip flop 399 to terminate the operation of the flashing lamp 407. The flip flop 411 is reset by a delayed pulse from the one shot 416 which is triggered by the set signal on the line 110. When the force print switch 75 is operated and a set signal is present on the line 110, the nand gate 451 of the flip flop 453 is activated to produce a force print signal on the line 121. The flip flop 453 remains activated so long as there is a busy command signal on the line 142 after which the flip-flop 453 resets to produce a force feed signal on the line 143.

When the alarm summary switch 76 is operated and a set signal is present on line 110, the flip flop 463 is activated to produce an alarm summary command signal on the line 118. Similarly, when the alarm status summary switch 77 is operated and a set signal is present on line 110, the flip flop 475 is activated to produce an alarm status summary command signal on line 119. Operation of the flip flop 463 operates the lamp 488 behind the alarm summary switch 76 while operation of the flip flop 475 operates the lamp 492 behind the alarm status summary switch 77. The flip flops 463 and 475 are normally reset by a summary reset signal on line 111. Also the flip flops 463 and 475 may be reset by the operation of the summary cancel switch 78.

The alarm summary command signals and the alarm status summary command signals are applied to the nand gates 462 and 472 to prevent the operation of either flip flop 463 or 475 when the other one thereof is operated. Also, the alarm summary command signal and the alarm status summary command signal are applied to the nand gate 450 to prevent the production of a force print signal on line 121 and a force feed signal on line 143 by operation of the force print switch 75. The key lock switch 82, when operated, disables the nand gates 450, 462, and 472 to prevent the production of a force print signal, an alarm summary command signal, or an alarm status summary command signal.

The function logic circuit 150 also contains a timing circuit for triggering the silicon controlled rectifier 431 a predetermined duration after the reapplication or the application of power to the circuitry. The silicon controlled rectifier 431 is rendered non conductive by any interruption of power, and when reapplied, the voltage across the silicon controlled rectifier 431 produces a current through the resistor 434 to charge the capacitor 435. After a predetermined duration, the voltage on the capacitor 435 is sufficient to trigger the unijunction transistor 436 which produces an output pulse across the resistor 438 applied by the resistor 440 to the control electrode of the silicon controlled rectifier 431 to render the silicon controlled rectifier conductive.

While the silicon controlled rectifier 431 is non-conductive, the flip flop 447 is operated to disable the nand gates 389, 397, 398, 452, 465 and 479 to prevent the production of the print cycle command signal on the line 120 upon receipt of an alarm pulse on lines 132, the alarm summary command signal on the line 118 and the alarm status summary command signal on the line 119. The flip flops 390, 399, 400, 453 and 463 are maintained by the respective disabled gates 389, 397, 398, 452 and 465 in their unoperated states. The nand gate 473 and the flip flop 475 are operated by the flip flop 447 during the predetermined duration after the reapplication or application of power to the circuitry. Thus, when the silicon controlled rectifier 431 is triggered into a conductive state and the nand gate 479 is enabled, an alarm status summary command signal is produced on line 119 to initiate the printing of an alarm status summary after the predetermined duration. Activation of the flip flop 475 disables the nand gate 462 to prevent operation of the amplifier 487 and the lamp 488 and operates nand gate 495 to disable the nand gate 450 to prevent the production of the force print signal on line 121 and the force feed signal on line 143 if the force feed switch 75 is operated. Also the flip flop 447, when operated, enables the nand gate 428 to pass set signals from the line 110 to produce alarm acknowledge signals on line 134 so that the memory 130, during the predetermined duration, stores received data signals as acknowledged alarm signals.

The operation of the printer sequencing circuit shown in FIG. 10 is initiated by the print cycle command signal on line 120 which allows the first phase clock signals on line 103 to be gated through to the serially connected latches 506–510. The latches 506–510 are sequentially activated and de-activated to produce the sequential point scanning signals on the lines 175*a*, 175*b*, and 175*c*. Also operation of the respective latches 506–509 produces output pulses from differentiator circuits 525–528 which operate a one shot circuit 539. When an alarm status summary command is present on the line 119, when a memory hold signal is present on the line 114 and when there is an absence of a print command inhibit signal on line 173, the output pulse of the one shot 539 is gated through nand gate 551 to produce a print command signal on line 176. Also the print command signal is produced whenever an alarm print command signal is present on line 172 during the absence of the memory hold signal or alarm status summary command signal or whenever a force print signal is present on line 121. The print command signal on line 176 as well as the output of the latch 509 operate the one shot 518 to produce a paper feed signal on the line 177. Also the paper feed signal is produced when a forced feed signal is present on line 143. A busy command signal on the line 142 disables the gate 504 to stop the sequencing of the latches and to allow the printing of the information of the station and point. After the point scanning operation and the paper feeding operation, the latch 510 produces a print cycle reset signal on line 144. Removal of the print cycle command signal from the line 120 resets the latches 506–510.

The print inhibit circuit of FIG. 11 generates inhibit signals on lines 161 to prevent the printing of acknowledged alarm signals during a alarm printing cycle initiated by an alarm pulse from the memory 130. The acknowledged alarm signals on the lines 138 are gated with the respective station selection signals on the lines 109 by the gates 558–566 to produce respective output signals when the corresponding station selection signal is present. Output gates 579–587 are disabled by a memory hold signal on line 114 to prevent the inhibit signals on lines 161 during an alarm summary operation or an alarm status summary operation to allow the printing of the acknowledged alarm points during such operations.

As perviously mentioned the alarm program matrix circuit shown in FIG. 12 is programmed by removing one or more of diodes 591–599 from between the respective terminals 601–609 and 611–619 in accordance with desired status points. Thus when a station selection signal is present on one of the lines 109, a corresponding line 163*a*, 163*b*, or 163*c* will produce an alarm enable signal for those points where the diodes have been left corresponding to alarm points being monitored.

During the point scanning operation of the printer sequencing circuit 170, the alarm status print decoder circuit shown in detail in FIG. 13 is effective to detect the condition of the status points and to detect alarm points which have been scanned. The data signals on the lines 128 are feed into latches 624–626. In the event that there is no data present for the corresponding point scanning signal on the lines 175 and the alarm enable signals on lines 163 indicate that the point corresponds to an alarm point, a print command inhibit signal is generated on line 173 to prevent the printing of non-operated alarm points or contacts. During a printing cycle command signal which was initiated by an alarm pulse from the memory 130, inhibit signals on the lines 161 are gated with the respective data signals from the latches 624–626 by the gates 634–636 to prevent the printing of the acknowledged alarms. However when an unacknowledged alarm is present for a particular point scanning signal or there is no corresponding inhibit signal present, the gates 634–636 produce outputs which are summed by the gate 638. Also the outputs of the gates 634–636 are gated with the alarm enable signals on lines 163 to produce an alarm print command signal on line 172 and a red print signal on line 181. The red print signal is gated with the output of the gate 638 to produce the on-off command signal on the line 179 when a status point is present.

The 24 hour clock circuit shown in detail in FIG. 14 is operated by the 1.5 hertz clock signal on the line 105. Counters 668 and 669 divide the 1.5 hertz signal by ninety to produce a one pulse per minute signal which operates serially connected counters 675, 681, 687 and 696. The counter 675 counts from 0–9 to correspond to the unit minutes, the counter 681 counts from 0–5 to indicate the ten minutes, the counter 687 counts from 0–9 to indicate the unit hours and the counter 696 counts from 0-to 2 to indicate the 10 hours. The nand gate 698, the nand gate 691 and the one shot 692 reset the unit hour counter 687 and 10 hour counter 696 to read 00 when the time reaches 24 hours and 1 minute. The counters 675, 681, 687 and 696 may be selectively advanced by operating the unit minute set switch 84, the ten minute set switch 85 and the hour set switch 86. The force print switch 75 shown on the console of FIG. 1 may be operated to print out the time of the clock and determine the correct setting. During a busy command signal on line 142, the output latches 705–717 are held to prevent a change of time information to the printer 89 when the printer is operating.

Since many variations, modifications and changes in detail may be made in the embodiment described in the above description and shown on the accompanying drawing without departing from the scope and spirit of the invention, the above description and the accompanying drawings shall be interrupted as illustrative and not in a limiting sense.

What is claimed is:

1. A condition monitoring system comprising a plurality of condition means, each for operating in response to a condition, having at least first and second groups of condition means;

sequencing means for sequentially generating a set signal, a first signal and a second signal;

first sensing means responsive to the first signal for sensing the operation of any condition means in the first group of condition means;

second sensing means responsive to the second signal for sensing the operation of any condition means in the second group of condition means;

indicating means responsive to any of the first and second sensing means sensing a condition for indicating the presence of the condition;

manual switch; and operation changing means responsive to a coincidence of the operation of the switch and a set signal for changing the operation of the indicating means.

2. A condition monitoring system comprising a plurality of contacts for indicating a condition when operated;

a first line connected to first terminals of a first group of the pluarlity of contacts;

a second line connected to first terminals of a second group of the plurality of contacts;

a third line connected to second terminals of first contacts, one first contact being in each of the first and second groups of contacts;

a fourth line connected to second terminals of second contacts, one second contact being in each of the first and second groups of contacts;

means for sequentially applying first and signals lines; to the respective first and second lines;

a plurality of memory means, each for changing from a first to a second state to indicate a condition, a respective one of the plurality of memory means corresponding to each of the plurality of contacts;

means for sequentially enabling respective first and second groups of the plurality of memory means in response to the first and second signals;

means for connecting the third line to inputs on first memory means of both first and second groups of the plurality of memory means to change respective enabled first memory means from the first state to the second state in response to a signal on the third line;

means for connecting the fourth line to inputs on second memory means of both first and second groups of the plurality of memory means to change respective enabled second memory means from the first state to the second state in response to a signal on the fourth line, and indicating means responsive to one of the plurality of memory means changing from a first state to a second state for indicating the presence of a condition.

3. A status condition and alarm condition monitoring system comprising a plurality of normally open contacts including (a) status contacts for indicating a status condition when closed and (b) alarm contacts for indicating an alarm condition when closed;

a first line connected to first terminals of a first group of the plurality of contacts;

a second line connected to first terminals of a second group of the plurality of contacts;

a third line connected to second terminals of first contacts, one first contact being in each of the first and second groups of contacts;

a fourth line connected to second terminals of second contacts, one second contact being in each of the first and second groups of contacts;

sequencing means for sequentially applying first and second electrical signals to the respective first and second lines;

a plurality of first latch circuits, each corresponding to a respective one of the plurality of contacts, a first group of the first latch circuits having input enabling means connected to the sequencing means for enabling the first latch circuits of the first group of first latch circuits during the first signal, a second group of the first latch circuits having input enabling means connected to the sequencing means for enabling each of the first latch circuits of the second group of first latch circuits during the second signal;

first connecting means for connecting an input of one first latch circuit of each of the first and second groups of latch circuits to the third line to change the one first latch circuits from first to second states when enabled and the respective first contacts are closed;

second connecting means for connecting an input of another first latch circuit of each of the first and second groups of first latch circuits to the fourth line to change the another first latch circuits from first to second states when enabled and the respective second contacts are closed;

a plurality of second latch circuits, each having an input connected to a corresponding one of the plurality of first latch circuits;

an alarm indicator;

first bistable means having first and second states for operating the alarm indicator when the first bistable means is in the second state;

first programmable means connected to the first latch circuits for changing the first bistable means to the second state when any of the first latch circuits corresponding to the alarm contacts change from the first state to the second state;

a manual switch for acknowledging the alarm condition;

third connecting means for connecting the manual switch to enabling inputs of the second latch circuits to change the second latch circuits which correspond to first latch circuits in the second state from first states to second states; and fourth connecting means connecting the manual switch to the first bistable means for changing the first bistable means from the second state to the first state to terminate operation of the alarm indicator.

* * * * *